US011305546B2

(12) United States Patent
Sohgawa

(10) Patent No.: US 11,305,546 B2
(45) Date of Patent: Apr. 19, 2022

(54) LIQUID DISCHARGE HEAD AND LIQUID DISCHARGE APPARATUS

(71) Applicant: Ricoh Company, Ltd., Tokyo (JP)

(72) Inventor: Norimasa Sohgawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/097,594

(22) Filed: Nov. 13, 2020

(65) Prior Publication Data

US 2021/0146692 A1 May 20, 2021

(30) Foreign Application Priority Data

Nov. 19, 2019 (JP) ..... JP2019-208524

(51) Int. Cl.
*B41J 2/175* (2006.01)

(52) U.S. Cl.
CPC ..... *B41J 2/17513* (2013.01); *B41J 2/17563* (2013.01)

(58) Field of Classification Search
CPC ..... B41J 2/17513; B41J 2/17563; B41J 2202/08; B41J 2/18
USPC ..... 347/85
See application file for complete search history.

(56) References Cited

U.S. PATENT DOCUMENTS

| | | | | |
|---|---|---|---|---|
| 2002/0180834 | A1* | 12/2002 | Silverbrook | B41J 2/14427 347/42 |
| 2009/0141093 | A1* | 6/2009 | Lee | B41J 2/17596 347/85 |
| 2009/0225130 | A1 | 9/2009 | Saito | |
| 2014/0313254 | A1 | 10/2014 | Sohgawa | |
| 2015/0306891 | A1 | 10/2015 | Sohgawa et al. | |
| 2017/0066236 | A1 | 3/2017 | Sohgawa et al. | |
| 2017/0129245 | A1 | 5/2017 | Kohda et al. | |
| 2018/0290446 | A1 | 10/2018 | Kohda et al. | |
| 2019/0270308 | A1 | 9/2019 | Watanabe et al. | |
| 2019/0283411 | A1 | 9/2019 | Sohgawa | |
| 2019/0283413 | A1 | 9/2019 | Katoh et al. | |
| 2020/0147973 | A1 | 5/2020 | Sohgawa | |
| 2020/0101726 | A1 | 6/2020 | Sohgawa | |
| 2020/0171819 | A1 | 6/2020 | Sohgawa | |

FOREIGN PATENT DOCUMENTS

| | | |
|---|---|---|
| JP | 2009-208385 | 9/2009 |
| JP | 2010-105377 | 5/2010 |
| JP | 2017-136720 | 8/2017 |
| JP | 2017-164917 | 9/2017 |

* cited by examiner

*Primary Examiner* — Kristal Feggins
*Assistant Examiner* — Alexander D Shenderov
(74) *Attorney, Agent, or Firm* — Xsensus LLP

(57) ABSTRACT

A liquid discharge head includes a connector component, a head unit, and a relay module component. The connector component is electrically connectable to a drive board. Ink from an ink chamber is supplied to the head unit. The relay module component is between the connector component and the head unit. The relay module component is detachable from the connector component and the head unit. The relay module component includes a channel to supply the ink supplied from the ink chamber to the head unit.

12 Claims, 18 Drawing Sheets

SUPPLY SIDE
(PRESSURE: HIGHER SIDE)
COLLECTION SIDE
(PRESSURE: LOWER SIDE)
FRONT SIDE
51
52
5012
52Yb
1011
51Ya
5011
52Ya
1012
51Yb
1021
3
51X
52X
5022
2
A
A'
B
B'
Y
X
Z 71
7011a
71Ya
801a
Z
Y
FRONT SIDE
7011b
71Yb
801b

SUPPLY SIDE
(PRESSURE: HIGHER SIDE)
B
71
71Ya
7011a
B'
Z
X
2
3
71X
7021
COLLECTION SIDE
(PRESSURE: LOWER SIDE)
A
A'
71Yb
7011b

SUPPLY SIDE
(PRESSURE: HIGHER SIDE)
B
91
1021'
3
51X'
51Ya'
1011'
B'
Z
X
2
A
A'
1012'
51Yb'

91
5012'
52Yb'
1011'
51Ya'
FRONT SIDE
92
1012'
51Yb'
5011'
52Ya'
Z
Y

LIQUID DISCHARGE HEAD AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-208524, filed on Nov. 19, 2019, in the Japan Patent Office, the entire disclosure of which is hereby incorporated by reference herein.

BACKGROUND

Technical Field

Embodiments of the present disclosure relate to a liquid discharge head and a liquid discharge apparatus.

Related Art

In order to suppress heat generation of a drive circuit, there is known a technique that provides a cover of a head with a channel (or flow path) shape to cool the drive circuit with ink. For example, a cover of a head is provided with a channel shape to cool a drive circuit with ink for the purpose of suppressing heat generation of the drive circuit.

SUMMARY

In an aspect of the present disclosure, there is provided a liquid discharge head that includes a connector component, a head unit, and a relay module component. The connector component is electrically connectable to a drive board. Ink from an ink chamber is supplied to the head unit. The relay module component is between the connector component and the head unit. The relay module component is detachable from the connector component and the head unit. The relay module component includes a channel to supply the ink supplied from the ink chamber to the head unit.

In another aspect of the present disclosure, there is provided a liquid discharge apparatus that includes the liquid discharge head.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 6A-1 is a cross-sectional view of the front side of the configuration example illustrated in FIG. 5 taken along line X-X' of FIG. 6A-2;

FIG. 6A-2 is a top view of the configuration example illustrated in FIG. 5;

FIG. 6B-1 is a cross-sectional view of the front side of the configuration example illustrated in FIG. 5 taken along the line X-X';

FIG. 6B-2 includes cross-sectional side views of the configuration example taken along line A-A' and line B-B' of FIG. 6B-1;

FIG. 6C-1 is a cross-sectional view of the front side of the configuration example illustrated in FIG. 5 taken along the line X-X';

FIG. 6C-2 is a top view of the configuration example taken along line C-C' of FIG. 6C-1;

FIG. 6C-3 is a top view of the configuration example taken along line D-D' of FIG. 6C-1;

FIG. 6C-4 is a top view of the configuration example taken along line E-E' of FIG. 6C-1;

FIG. 8A-1 is a cross-sectional view of the front side of the configuration example illustrated in FIG. 7 taken along line X-X' of FIG. 8A-2;

FIG. 8A-2 is a top view of the configuration example illustrated in FIG. 7;

FIG. 8B-1 is a cross-sectional view of the front side of the configuration example illustrated in FIG. 7 taken along the line X-X';

FIG. 8B-2 includes cross-sectional side views of the configuration example taken along line A-A' and line B-B' of FIG. 8B-1;

FIG. 8C-1 is a cross-sectional view of the front side of the configuration example illustrated in FIG. 7 taken along the line X-X';

FIG. 8C-2 is a top view of the configuration example taken along line C-C' of FIG. 8C-1;

FIG. 8C-3 is a top view of the configuration example taken along line D-D' of FIG. 8C-1;

FIG. 8C-4 is a top view of the configuration example taken along line E-E' of FIG. 8C-1;

FIG. 10A-1 is a cross-sectional view of the front side of the configuration example illustrated in FIG. 9 taken along line X-X' of FIG. 10A-2;

FIG. 10A-2 is a top view of the configuration example illustrated in FIG. 7;

FIG. 10B-1 is a cross-sectional view of the opposite side of the front side of the configuration example illustrated in FIG. 9 taken along line Y-Y' of FIG. 10B-2;

FIG. 10B-2 is a top view of the configuration example illustrated in FIG. 9;

FIG. 10C-1 is a cross-sectional view of the front side of the configuration example illustrated in FIG. 9 taken along the line X-X';

FIG. 10C-2 includes cross-sectional side views of the configuration example taken along line A-A' and line B-B' of FIG. 10C-1;

FIG. 10D-1 is a cross-sectional view of the front side of the configuration example illustrated in FIG. 9 taken along the line X-X';

FIG. 10D-2 is a top view of the configuration example taken along line C-C' of FIG. 10D-1;

FIG. 10D-3 is a top view of the configuration example taken along line D-D' of FIG. 10D-1;

FIG. 10D-4 is a top view of the configuration example taken along line E-E' of FIG. 10D-1;

Figure 1:
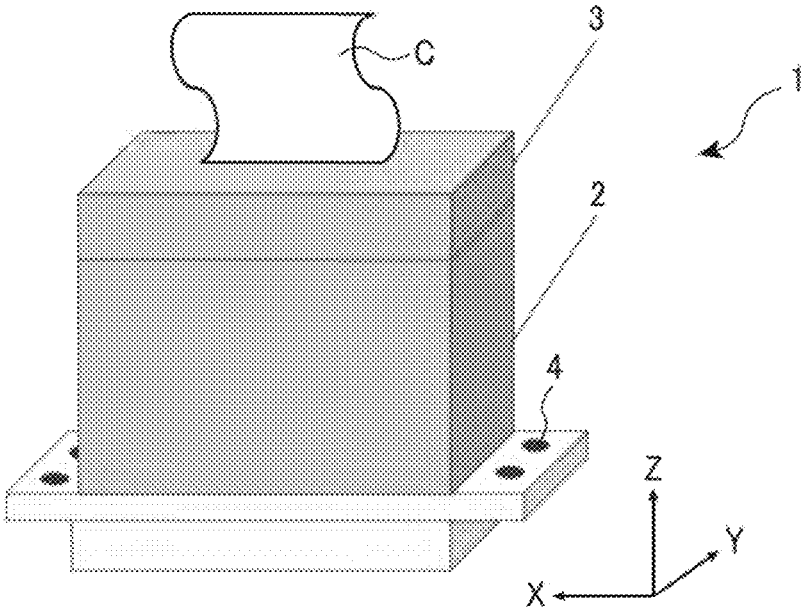
FIG. 1 is an illustration of a configuration example of a print head in a state in which a relay module component is not connected.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of a liquid discharge head and a liquid discharge apparatus are described in detail with reference to the accompanying drawings. The liquid discharge head and the liquid discharge apparatus according to the present embodiment have the following features with respect to an ink path connected to a print head. In other words, a block component is integrated with a relay component in other words detachably attachable to a print head. The block component has a function of integrating and branching an ink path on the upstream side from a point at which ink reaches the print head. Thus, the relay component can be selected according to the application, and the ink path can be easily designed in accordance with the print head. In addition, since the ink path is accommodated in the block component, the ink path does not exceed the size of the projection surface of the print head, thus preventing the ink path from interfering with the print head when a plurality of print heads are arranged in a printer. Further, since the relay component is electrically connected between a connector component and the print head, the temperature of ink in the block component can be controlled by power supply. Such features are described in detail with reference to the following drawings.

FIG. 1 is an illustration of a configuration example of a print head in a state in which a relay module component is not connected. As illustrated in FIG. 1, the print head 1 includes a head body 2 and a connector component 3 in other words a cable component including a cable C to be connected to a drive board. The head body 2 and the connector component 3 is connectable and disconnectable. The print head 1 includes four ink supply ports 4 on both sides in a longitudinal direction of the print head 1. Two of the four ink supply ports 4 are disposed on one side and the other two are disposed on the other side in the longitudinal direction, thus allowing the print head 1 to be used for two color use or single-color use.

Figure 2:
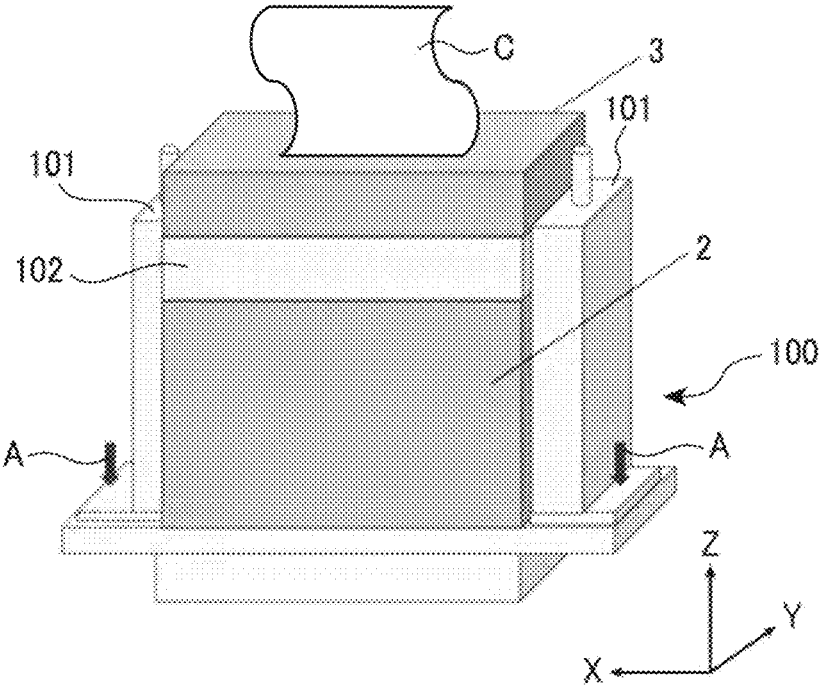
FIG. 2 is an illustration of a configuration example of a print head in a state in which a relay module component is connected.

FIG. 2 is an illustration of a configuration example of a print head in a state in which a relay module component is connected. As illustrated in FIG. 2, in the print head 1, a relay module component 100 is electrically connected between the head body 2 and the connector component 3. The relay module component 100 includes supply port relay portions 101 and a module relay portion 102. The supply port relay portions 101 includes paths that relay the supply of ink to the ink supply ports 4 on both sides in the longitudinal direction of the print head 1. The module relay portion 102 has a path that relays the supply of ink between the supply port relay portions 101. In FIG. 2, the relay module component 100 is inserted between the head body 2 and the connector component 3, is detachably fixed by an upper connector and a lower connector, and is fixed to the head body 2 at mounting portions A in other words mounting holes of the head body 2. The pressure of ink supplied to a channel in the relay module component 100 can be adjusted by an ink supply control device. For example, a pressure difference can be generated between the supply port relay portions 101. Note that a detachable filter may be attached in the channel of the relay module component 100 described below. Such a configuration allows the supplied ink to be filtered.

Figure 3C:
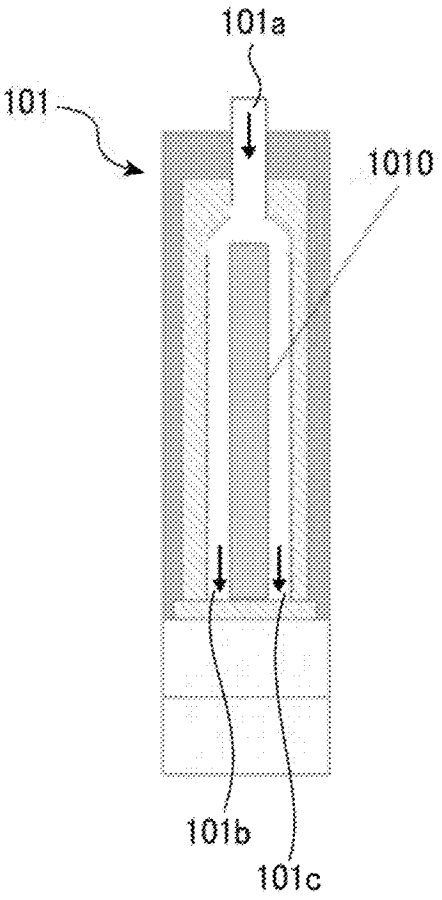
FIG. 3C is a cross-sectional side view of still another example of the relay module component connected to the print head illustrated in FIG. 2.
Figure 3B:
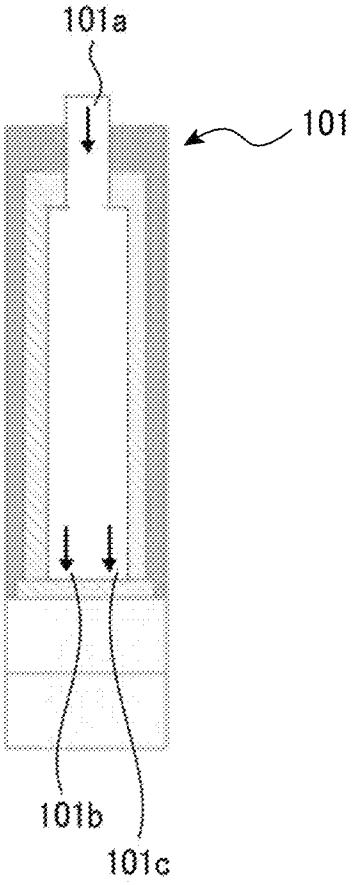
FIG. 3B is a cross-sectional side view of another example of the relay module component connected to the print head illustrated in FIG. 2.
Figure 3A:
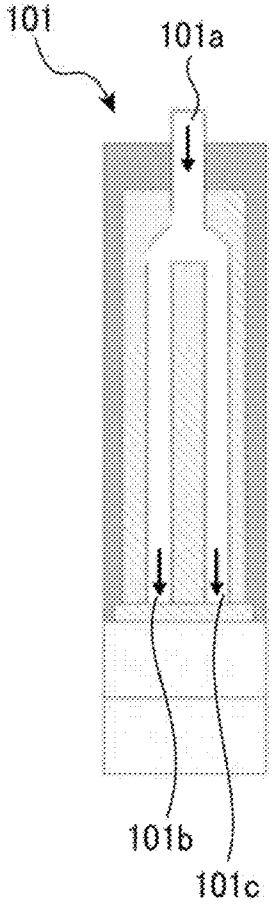
FIG. 3A is a cross-sectional side view of an example of the relay module component connected to the print head illustrated in FIG. 2.

FIGS. 3A to 3C are sectional side views of the relay module component 100 connected to the print head illustrated in FIG. 2. FIG. 3A depicts a cross section of the supply port relay portion 101 connected to the ink supply port 4. As illustrated in FIG. 3A, the supply port relay portion 101 is provided with one ink supply port 101*a* on the upstream side to which ink is supplied from ink containers under, e.g., pressure control by an ink supply control device. The supply port relay portion 101 has a configuration in which ink paths inside the supply port relay portion 101 are separated according to the widths of two ink supply destinations 101*b* and 101*c* so that ink can be supplied to the ink supply destinations 101*b* and 101*c* on the downstream side. As described above, the channel of the relay module component 100 is configured to branch between the ink supply port 101*a* to which ink is supplied and the ink supply destinations 101*b* and 101*c* to which the ink supplied from the ink supply port 101*a* is supplied and which are more than the ink supply port. In the present example, the configuration in which the channel is branched is exemplified. However, in some embodiments, the channel of the relay module component 100 may be integrated between the ink supply port to which ink is supplied and the supply ports of the head body 2 that are the supply destinations of the ink supplied from the ink supply port and the number of which is smaller than the number of the ink supply ports. Alternatively, the channel of the relay module component 100 may have a configuration in which branching and integration are combined. Accordingly, various channels can be set according to the environment in which ink is supplied.

FIG. 3B depicts another example of a cross section of the supply port relay portion 101 connected to the ink supply port 4. As illustrated in FIG. 3B, the supply port relay portion 101 is provided with one ink supply port 101*a* on the upstream side to which ink is supplied from ink containers under, e.g., pressure control. The supply port relay portion 101 is one liquid chamber in which the widths of ink paths inside the supply port relay portion 101 are configured according to the widths of two ink supply destinations 101*b* and 101*c* so that ink can be supplied to the ink supply destinations 101*b* and 101*c* on the downstream side.

With the configuration illustrated in FIGS. 3A and 3B, the relay module component 100 serving as a component for integrating the ink paths can be firmly fixed to the head body 2, thus facilitating wiring of the ink paths.

FIG. 3C is a diagram of an example of a configuration in which a heater 1010 is provided in the supply port relay portion 101 of the relay module component 100. FIG. 3C illustrates a case in which a separation wall for separating the ink paths of the supply port relay portion 101 illustrated in FIG. 3A is replaced with the heater 1010 or a case in which the heater 1010 is provided in a middle portion in the short direction of the liquid chamber of the supply port relay portion 101 illustrated in FIG. 3B. In such configurations, when sufficient heating is not performed by the heater inside the head body 2, heating can be performed in the relay module component 100 to stabilize the discharge of the ink. By dividing the current for the heater supplied to the head body 2 by the connector component 3, the heater 1010 can control the temperature of the remaining heat without preparing an additional power source.

Figure 4:
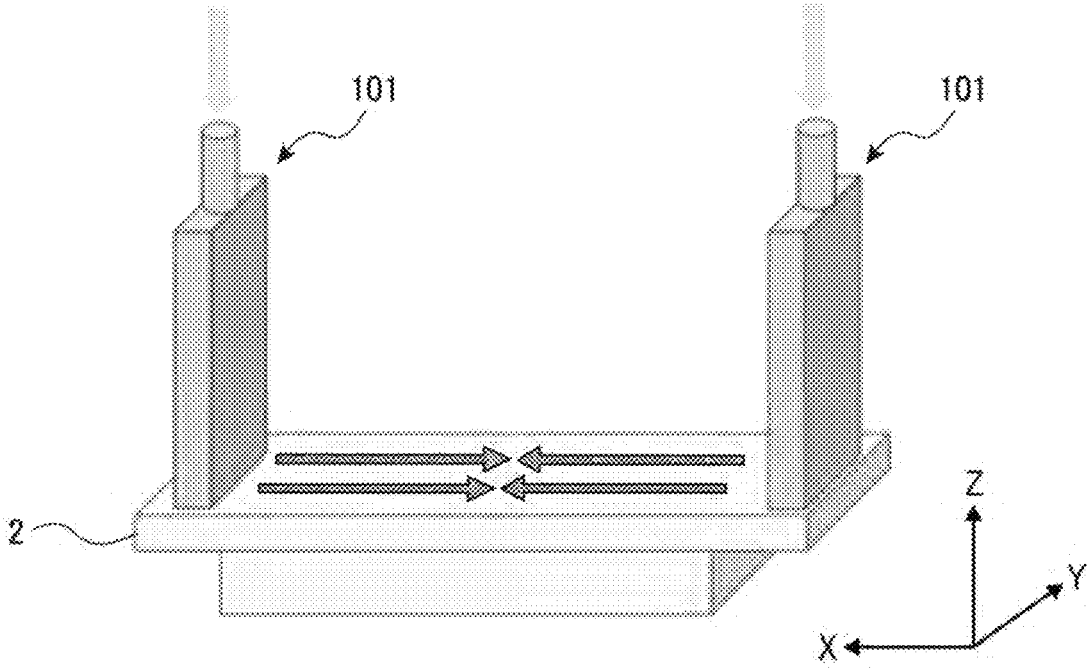
FIG. 4 is an illustration of an ink path through supply port relay portions of the relay module component.

FIG. 4 is an illustration of an ink path through the supply port relay portion 101 of the relay module component 100. As illustrated in FIG. 4, ink is supplied through the ink paths of the supply port relay portions 101 on both sides of the head body 2. In the supply port relay portion 101, since the ink paths are separated as illustrated in FIGS. 3A to 3C, the ink supplied to the ink supply port 101*a* is output from the ink supply destinations 101*b* and 101*c* to the head body 2 through two ink paths. In FIG. 4, the ink paths via the supply port relay portions 101 have been described. However, ink may be supplied to and collected from the head body 2 via the module relay portion 102.

Figure 5:
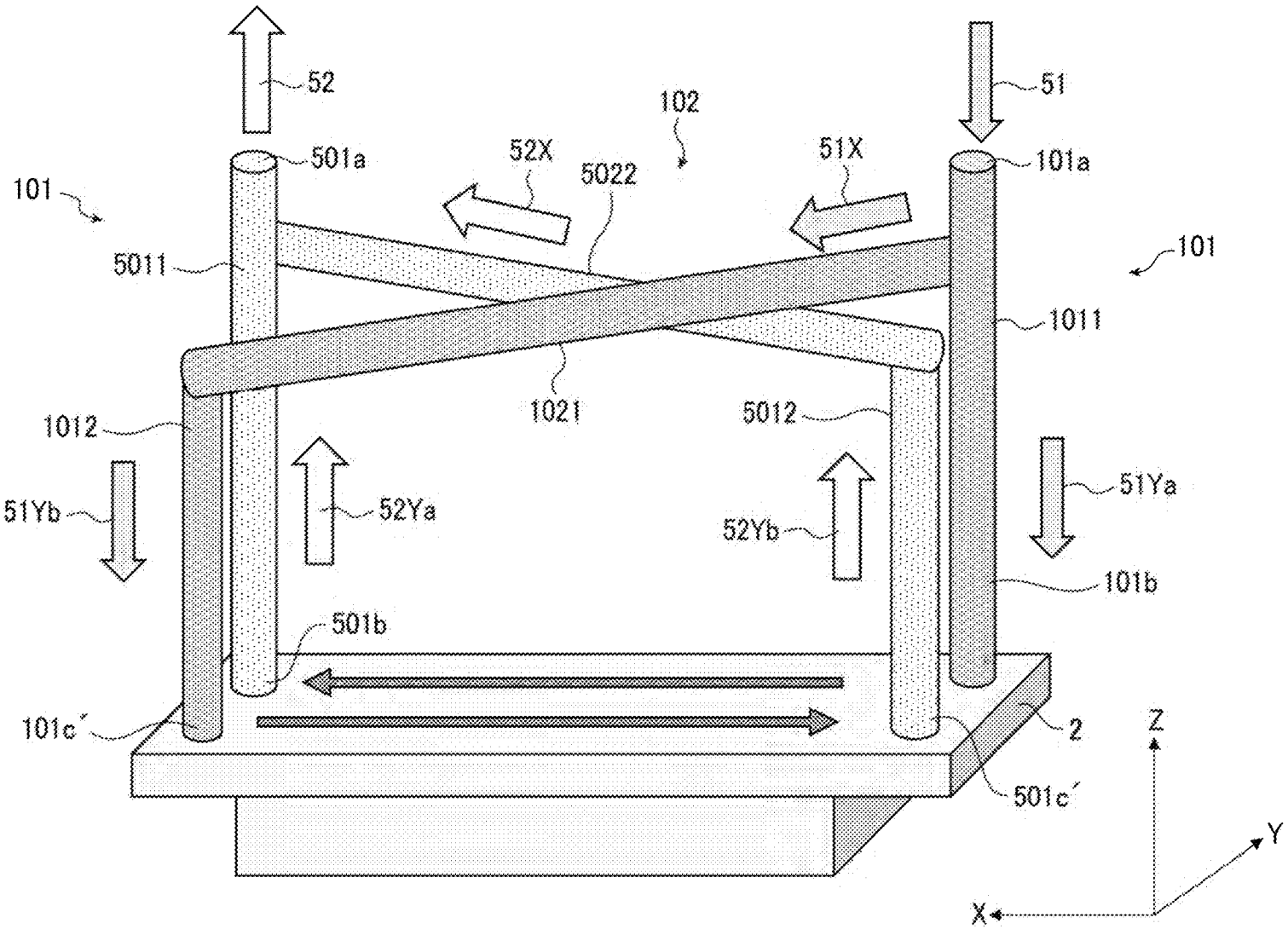
FIG. 5 is an illustration of a configuration example in which ink is supplied to and collected from a head body via the supply port relay portions and a module relay portion.

FIG. 5 is an illustration of a configuration example in which ink is supplied to and collected from the head body 2 via the supply port relay portions 101 and the module relay portion 102. In FIG. 5, one supply port relay portion 101 of the supply port relay portions 101 includes a channel 1011 and a channel 501. The channel 1011 is a vertical path to supply ink from the ink supply port 101*a* to the ink supply destination 101*b*. The channel 5012 is a vertical path to collect the supplied ink from an ink collection destination 501*c*' to the module relay portion 102. The other supply port relay portion 101 of the supply port relay portions 101 includes a channel 1012 and a channel 5011. The channel 1012 is a vertical path to supply ink from the ink supply port 101*a* to an ink supply destination 101*c*' of the other supply port relay portion 101 via the module relay portion 102. The channel 5011 is a vertical path to recover the supplied ink from an ink collection destination 501*b* to the ink collection port 501*a*.

Further, in FIG. 5, the module relay portion 102 includes a channel 1021 and a channel 5022 to connect the supply port relay portions 101 to each other. The channel 1021 is a channel to supply the ink from the ink supply port 101*a* from the channel 1011 of the one supply port relay portion 101 to the channel 1012 of the other supply port relay portion 101. The channel 5022 is a channel to collect the ink collected from the ink collection destination 501*c*' of the one supply port relay portion 101, from the channel 5012 to the channel 5011.

In other words, in FIG. 5, the ink supplied from the ink supply port 101*a* in a direction 51 is separated in a direction 51X and a direction 51Ya in the one supply port relay portion 101 of the relay module component 100, and then supplied to the head body 2. Further, the ink is supplied to the head body 2 in a direction 51Yb in the other supply port relay portion 101 on the opposite side via the module relay portion 102. In addition, in the one supply port relay portion 101 of the relay module component 100, the ink collected in a direction 52Yb from the ink collection destination 501*c*' is collected in a direction 52X via the module relay portion 102 and then collected in a direction 52 in the channel 5011 of the other supply port relay portion 101. The ink collected in a direction 52Ya from the collection destination 501*b* is collected in the direction 52 in the channel 5011 of the other supply port relay portion 101.

Figures 2, 6A:
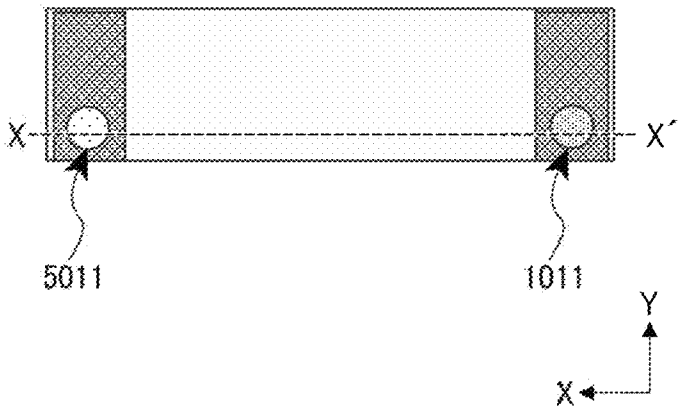
Figures 1, 6A:
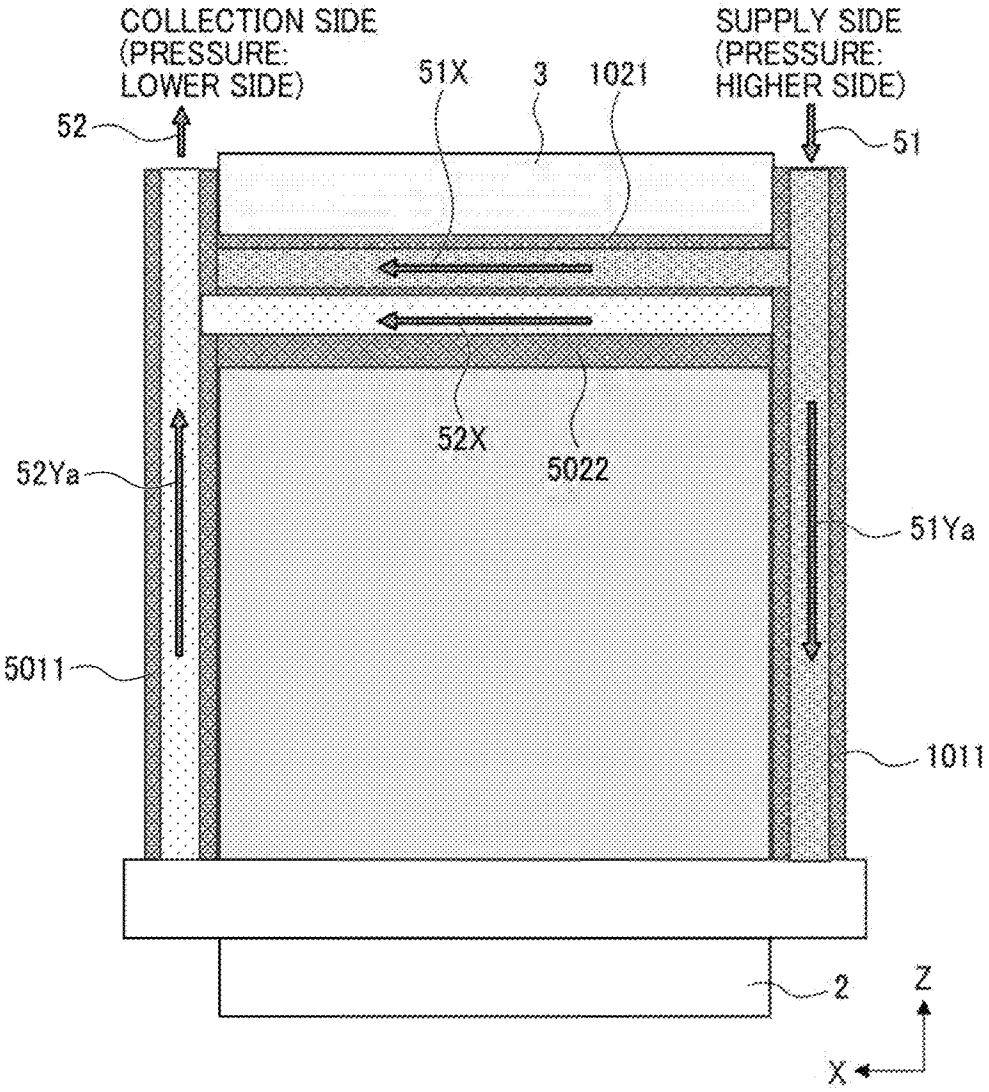

FIG. 6A-1 is a cross-sectional view of the front side of the configuration example illustrated in FIG. 5 taken along line X-X'. FIG. GA-2 is a top view of the configuration example illustrated in FIG. 5. As illustrated in FIG. 6A-1, the ink supplied from the ink supply port 101*a* in the direction 51 is separated into the direction 51Ya and the direction 51X and then supplied to the head body 2. The ink collected from the head body 2 and merged from the direction 52X and the direction 52Ya is collected in the direction 52. In addition, as illustrated in FIG. 6A-2, the channel 1011 and the channel 5011 are disposed at opposing positions in the longitudinal direction of the head body 2 such that the ink supply port 101*a* and the ink collection port 501*a* of the supply port relay portion 101 are on the same front side of the head body 2.

Figures 1, 2, 6B:
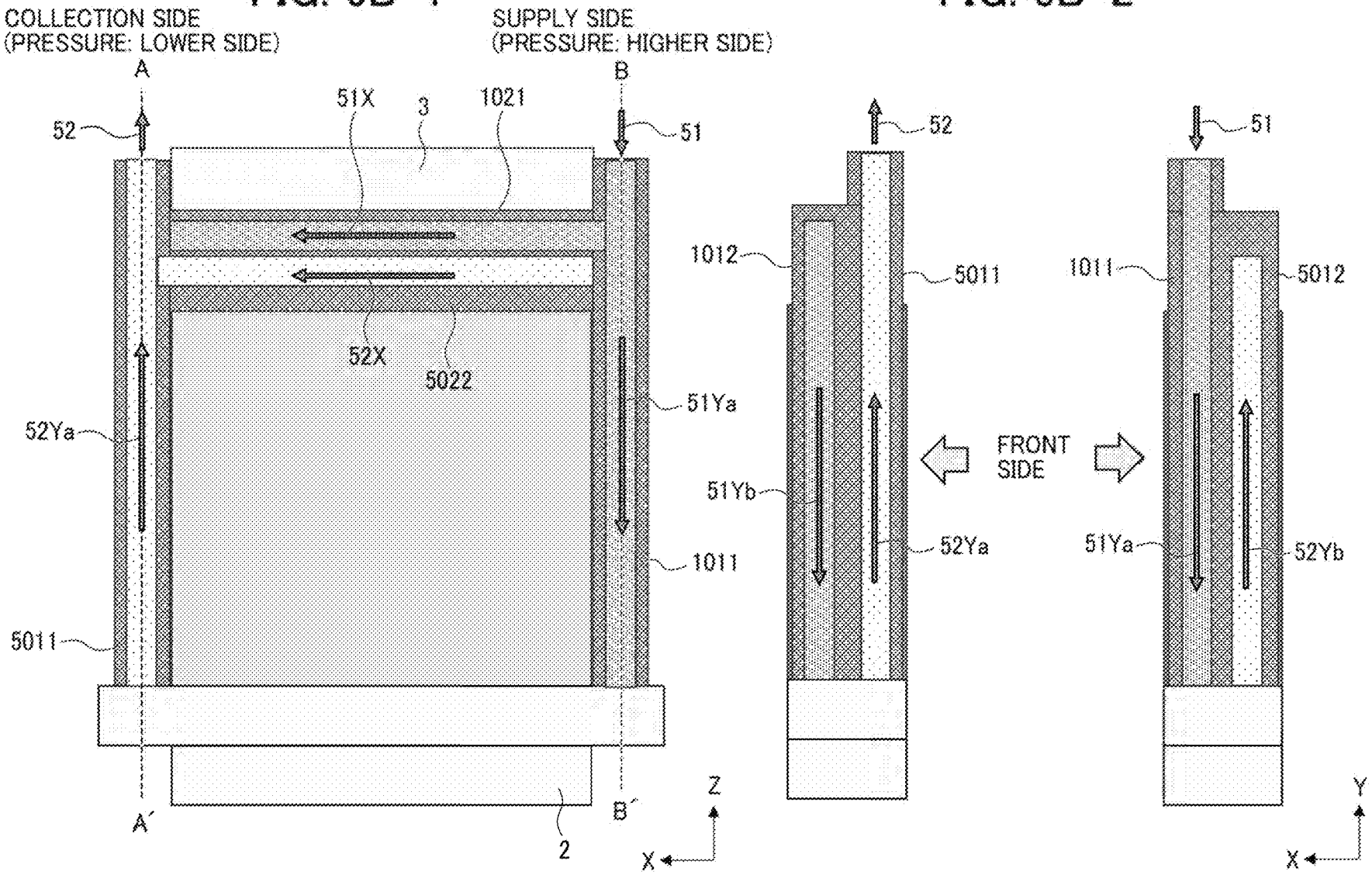

FIG. 6B-1 is a cross-sectional view of the front side of the configuration example illustrated in FIG. 5 taken along line X-X'. FIG. 6B-2 includes cross-sectional side views of the configuration example taken along line A-A' and line B-B' of FIG. 6B-1. Since FIG. 6B-1 is the same as FIG. 6A-1, the description thereof are omitted here and FIG. 6B-2 is described below. As illustrated in FIG. 6B-2, the supply port relay portions 101 on both sides of the head body 2 include vertical channels to supply ink and vertical channels to collect ink. For example, the supply port relay portion 101 illustrated in the cross-sectional view of FIG. 6B-2 taken along the line A-A' includes the channel 1012 to supply ink in the direction 51Yb and the channel 5011 to collect ink in the direction 52Ya. For example, the supply port relay portion 101 illustrated in the cross-sectional view of FIG. 6B-2 taken along the line B-B' includes the channel 1011 to supply ink in the direction 51Ya and the channel 5012 to collect ink in the direction 52Yb.

Figures 1, 6C:
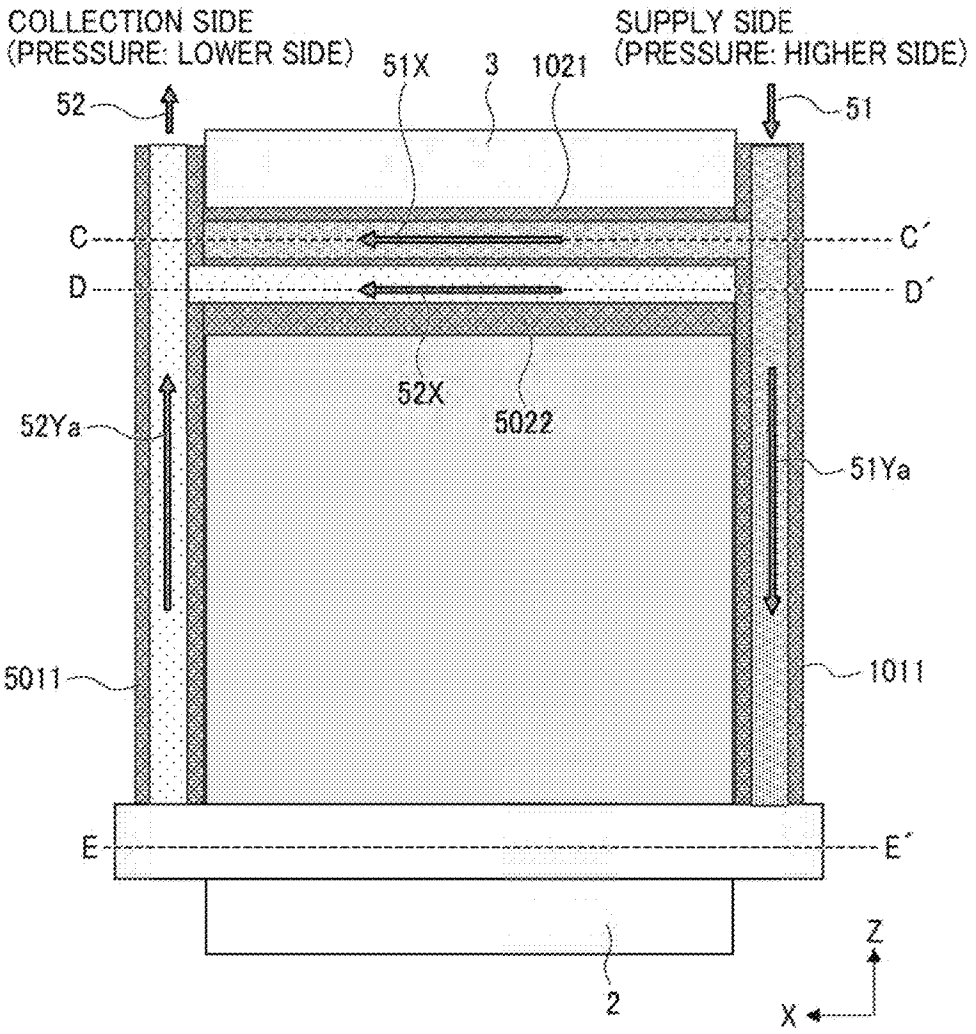
Figures 2, 6C:
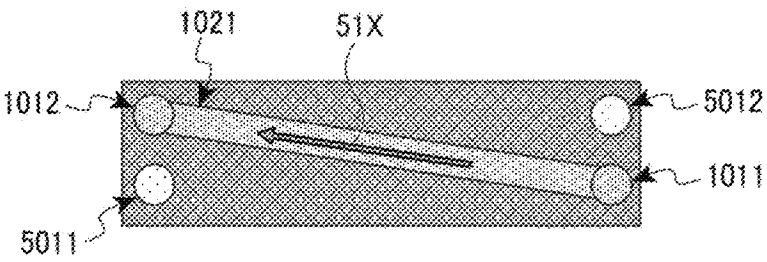
Figures 3, 6C:
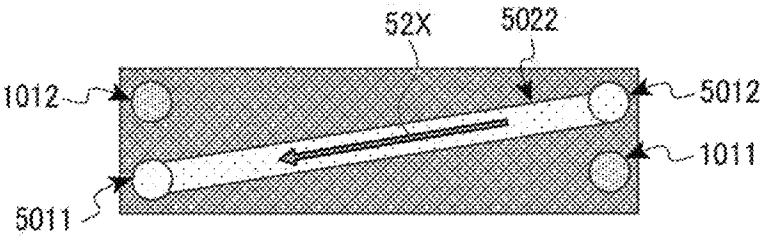
Figures 4, 6C:
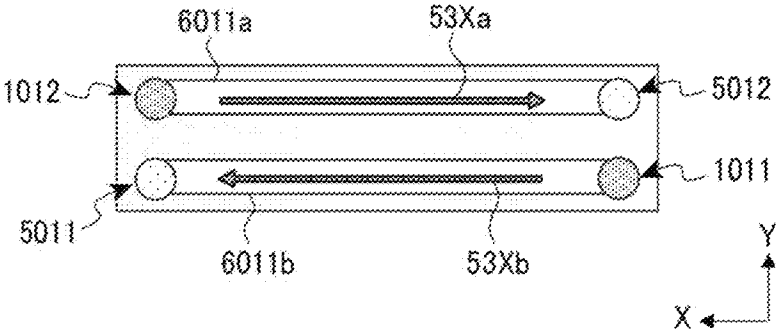

FIG. 6C-1 is a cross-sectional view of the front side of the configuration example illustrated in FIG. 5 taken along line X-X'. FIG. 6C-2 is a top view of the configuration example taken along line C-C' of FIG. 6C-1. FIG. 6C-3 is a top view of the configuration example taken along line D-D' of FIG. 6C-1. FIG. 6C-4 is a top view of the configuration example taken along line E-E' of FIG. 6C-1. Since FIG. 6C-1 is the same as FIG. 6A-1, the description thereof is omitted and FIGS. 6C-2, 6C-3, and 6C-4 are described here. As illustrated in FIGS. 6C-2, 6C-3, and 6C-4, the module relay portion 102 that relays the supply port relay portions 101 on both sides of the head body 2 includes a horizontal channel to supply ink and a horizontal channel to collect ink. For example, the module relay portion 102 illustrated in the top view of FIG. 6C-2 taken along the line C-C' includes the channel 1021 to supply ink in the direction 51X that forms a diagonal line across the channel 5022. In addition, for example, the module relay portion 102 illustrated in the top view of FIG. 6C-3 taken along the line D-D' includes the channel 5022 to collect ink in the direction 52X that forms a diagonal line across the channel 1021. Further, for example, the module relay portion 102 illustrated in the top view of FIG. 6C-4 taken along the line E-E' includes a channel 6011*a* to circulate ink in a direction 53Xa and a channel 6011*b* to circulate ink in a direction 53Xb opposite to the direction 53Xa.

Such a configuration allows ink in the common liquid chambers to be circulated between the common liquid chambers. At this time, a pressure difference between both sides of the head body 2 (head portions at both ends in the longitudinal direction of the head body 2) causes ink in the respective liquid chambers to be mutually circulated between the respective liquid chambers. Thus, the ink can be circulated without designing a special ink tank. The carriage size can be designed to be compact without using the upper space of the head body 2 while the ink tank is provided with the head 2.

In FIGS. 5 and 6A-1 to 6C-4, the configurations in the case in which ink is circulated is illustrated. However, as illustrated in FIG. 4, in the case in which ink is supplied through the ink paths of the supply port relay portions 101 on both sides of the head body 2 without circulation of the ink, for example, the following configuration may be employed.

Figure 7:
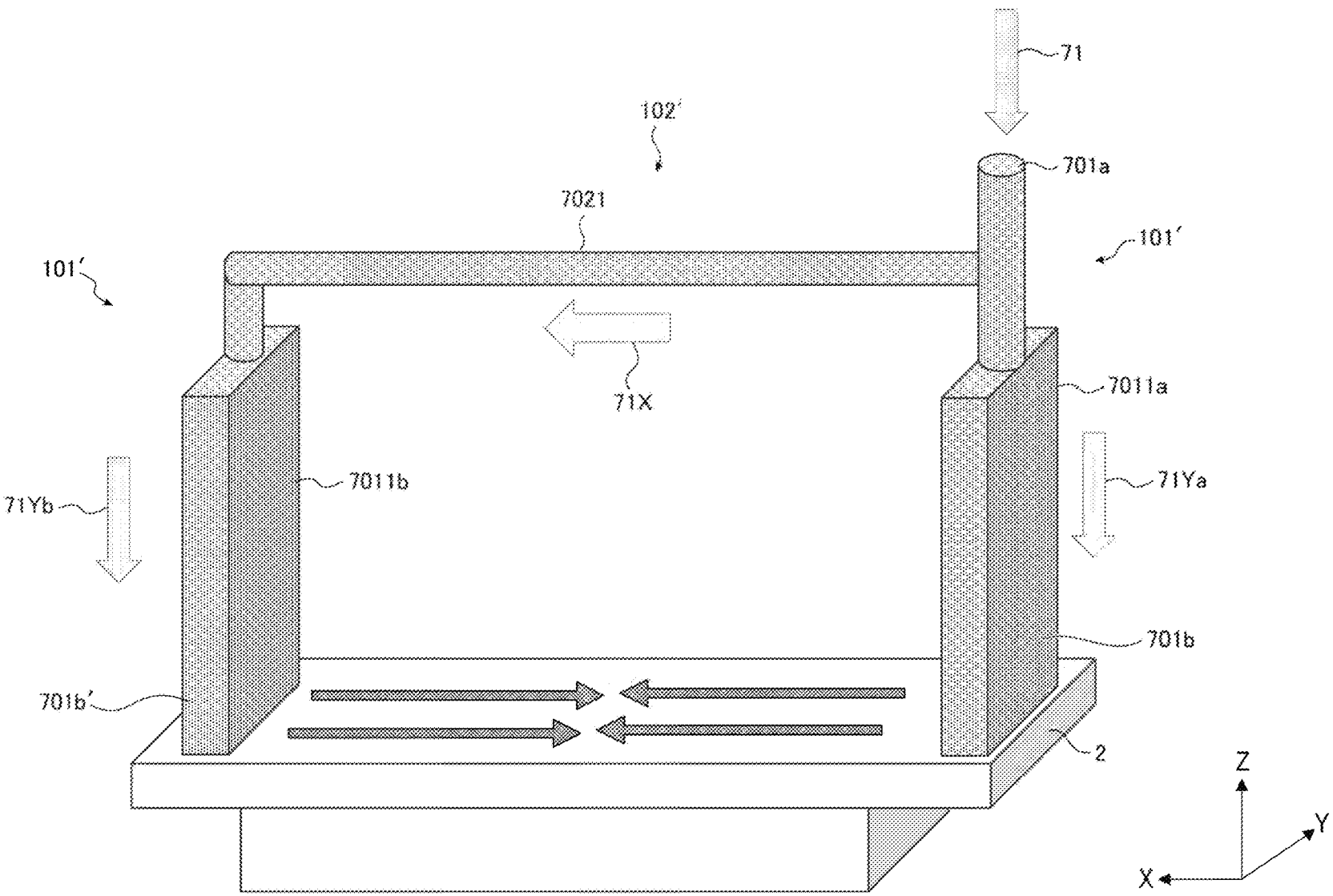
FIG. 7 is an illustration of a configuration example in which ink is supplied to a head body via supply port relay portions and a module relay portion.

FIG. 7 is an illustration of a configuration example in which ink is supplied to a head body 2 via supply port relay portions 101 and a module relay portion 102 as illustrated in FIG. 4. In FIG. 7, one supply port relay portion 101' of the supply port relay portions 101 includes a channel 7011*a* having a liquid chamber shape. The channel 7011*a* is a path in a vertical direction 71Ya through which ink is supplied from an ink supply port 701*a* to an ink supply destination 701*b*. In addition, the other supply port relay portion 101' includes a channel 7011*b* having a liquid chamber shape. The channel 7011*b* is a path in a vertical direction 71Yb through which ink is supplied from the ink supply port 101*a* to an ink supply destination 701*b*' of the other supply port relay portion 101' via the module relay portion 102.

Further, in FIG. 7, a module relay portion 102' includes a channel 7021 to connect the supply port relay portions 101' to each other. The channel 1021 is a channel to supply ink from the ink supply port 101*a*, from the one supply port relay portion 101' to the other supply port relay portion 101'.

In other words, in FIG. 5, the ink supplied from the ink supply port 101*a* in a direction 71 is separated in a direction 71Ya and a direction 71X in the one supply port relay portion 101 of the relay module component 100, and then supplied to the head body 2. Further, the ink is supplied to the head body 2 in a direction 71Yb in the other supply port relay portion 101 on the opposite side via the module relay portion 102'.

Figures 2, 8A:
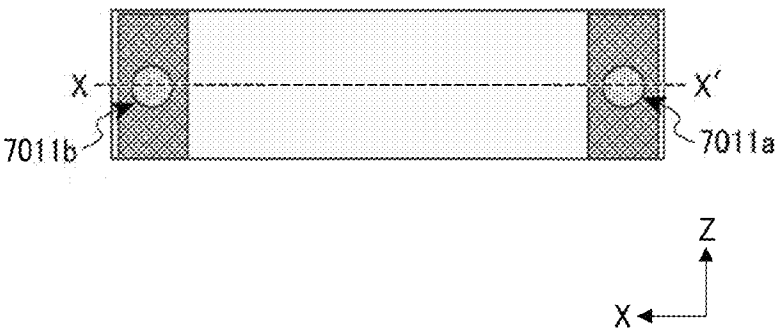
Figures 1, 8A:
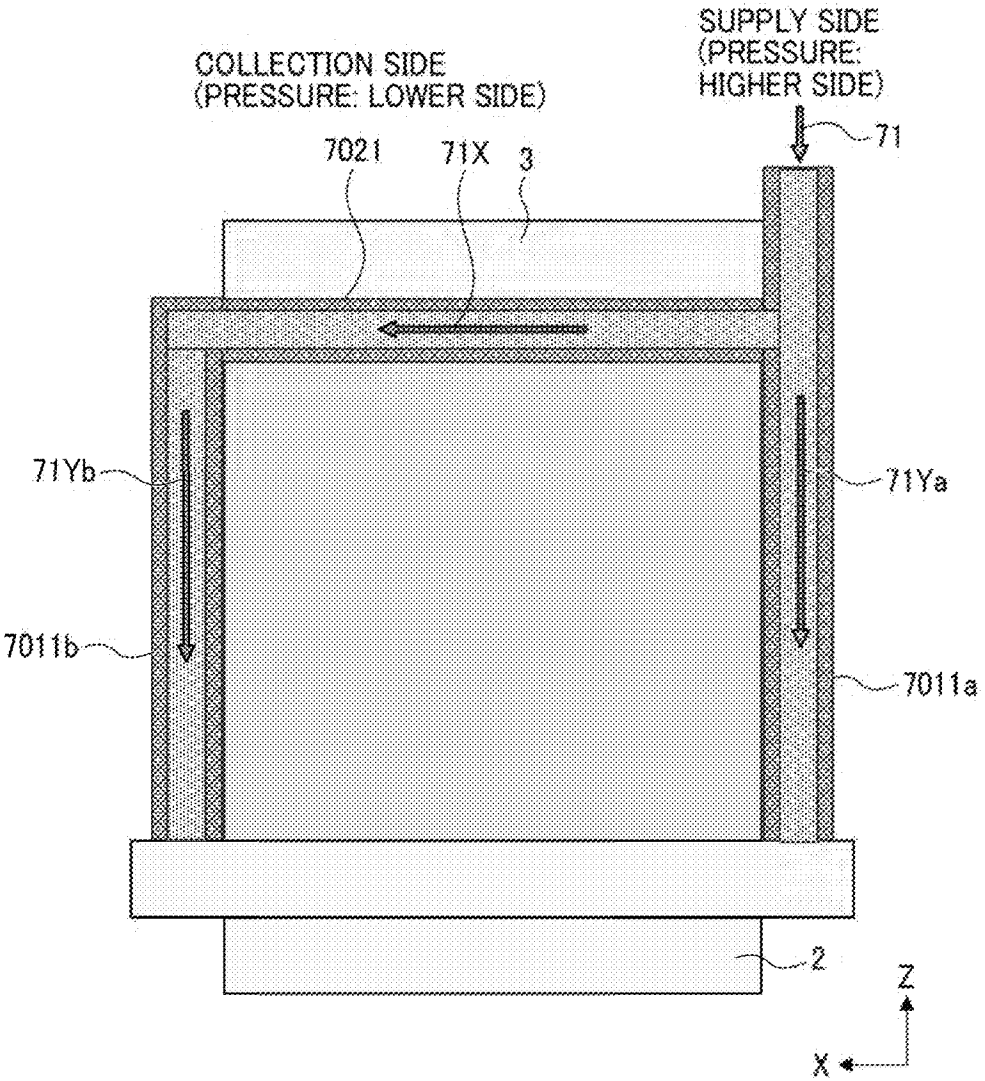

FIG. 8A-1 is a cross-sectional view of the front side of the configuration example illustrated in FIG. 7 taken along line X-X'. FIG. 8A-2 is a top view of the configuration example illustrated in FIG. 7. As illustrated in FIG. 8A-1, ink supplied from the ink supply port 701*a* in the direction 71 is separated into the direction 71Ya and the direction 71X and then supplied to the head body 2. In addition, as illustrated in FIG. 8A-2, the channel 7011*a* of the one supply port relay portion 101' and the channel 7011*b* of the other supply port relay portion 101', which are opposed to each other, are disposed at a central portion in a short direction of the head body 2.

Figures 1, 2, 8B:
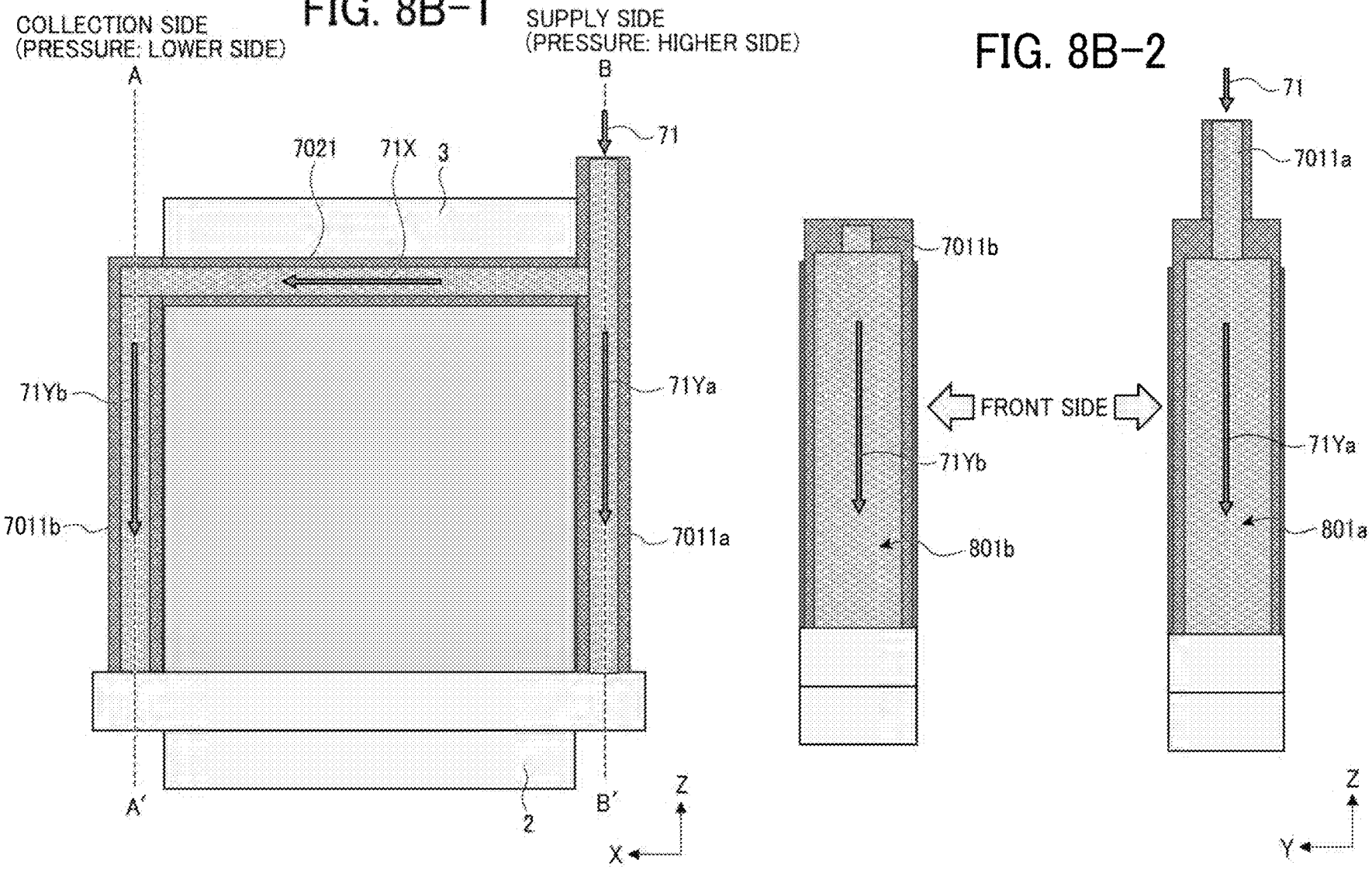

FIG. 8B-1 is a cross-sectional view of the front side of the configuration example illustrated in FIG. 7 taken along line X-X'. FIG. 8B-2 includes cross-sectional side views of the configuration example taken along line A-A' and line B-B' of FIG. 8B-1. Since FIG. 8B-1 is the same as FIG. 8A-1, the description thereof is omitted and FIG. 8B-2 is described below. As illustrated in FIG. 8B-2, the supply port relay portions 101' on both sides of the head body 2 include vertical channels to supply ink. For example, the supply port relay portion 101' illustrated in the cross-sectional view of FIG. 8B-2 taken along the line A-A' includes one liquid chamber 801*b* as the channel 7011*b* that supplies ink in the direction 71Yb. In addition, for example, the supply port relay portion 101' illustrated in the cross-sectional view of FIG. 8B-2 taken along the line B-B' includes one liquid chambers 801*a* as the channel 7011*a* which supplies the ink in the direction 71Ya.

Figures 1, 8C:
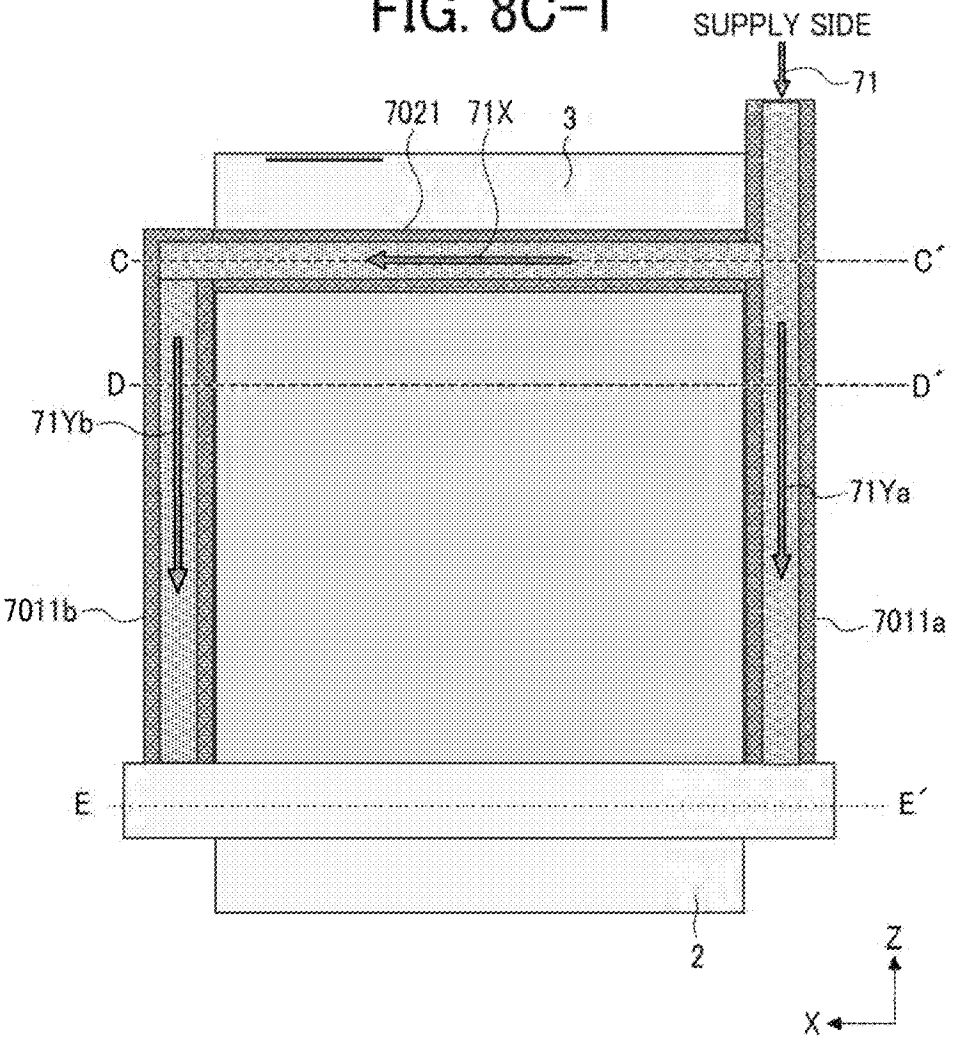
Figures 2, 8C:
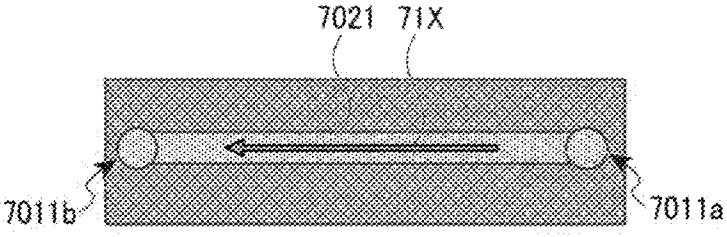
Figures 3, 8C:
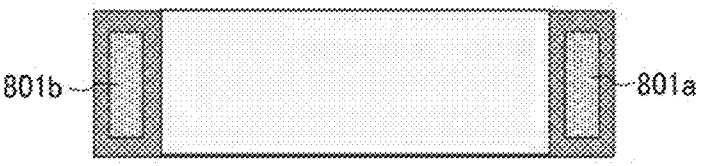
Figures 4, 8C:
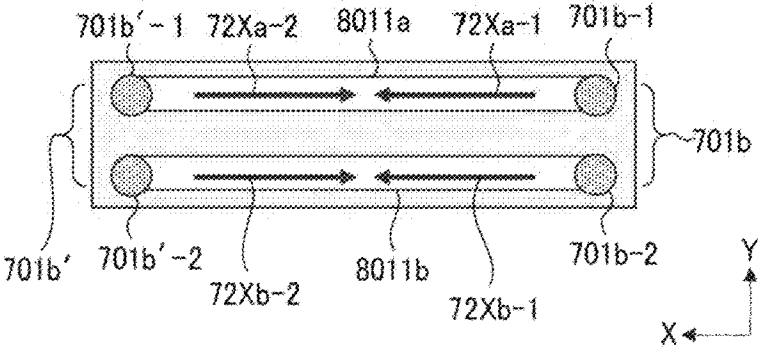

FIG. 8C-1 is a cross-sectional view of the front side of the configuration example illustrated in FIG. 7 taken along line X-X'. FIG. 8C-2 is a top view of the configuration example taken along line C-C' of FIG. 8C-1. FIG. 8C-3 is a top view of the configuration example taken along line D-D' of FIG. 8C-1. FIG. 8C-4 is a top view of the configuration example taken along line E-E' of FIG. 8C-1. Since FIG. 8C-1 is the same as FIG. 8A-1, the description of FIG. 8C-1 is omitted and FIGS. 8C-2, 8C-3, and 8C-4 are described below. As illustrated in FIGS. 8C-2, 8C-3, and 8C-4, the module relay portion 102' that relays the supply port relay portions 101' on both sides of the head body 2 includes horizontal channels to supply ink. For example, in the top view of FIG. 8C-2 taken along the line C-C', the module relay portion 102' is not provided, and the liquid chamber 801*a* and the liquid chamber 802*b* are disposed. Further, for example, the module relay portion 102' illustrated in the top view of FIG. 6C-4 taken along the line E-E' includes a channel 8011*a* and a channel 8011*b*. The channel 8011*a* supplies ink from one supply destination 701*b*-1 of the ink supply destinations 701*b* of one liquid chamber 801*a* in a direction 72Xa-1 and from one supply destination 701*b*'-1 of the other liquid chamber 801*b* in a direction 72Xa-2 opposite to the direction 72Xa-1. The channel 8011*b* supplies ink from the other supply destination 701*b*-2 of the ink supply destinations 701*b* of the one liquid chamber 801*a* in a direction 72Xb-1 and from the other supply destination 701*b*'-2 of the other liquid chamber 801*b* in a direction 72Xb-2 opposite to the direction 72Xb-1.

Such a configuration can achieve stable supply of ink through the common liquid chambers. In addition, as described with reference to FIGS. 3A, 3B, and 3C, the relay module component 100 as a component that integrates the ink paths can be firmly fixed to the head body 2, thus facilitating the layout of the ink paths.

In FIGS. 5 and 6A-1 to 6C-4, the configurations in which ink is supplied to the head body 2 through the module relay portion 102 and collected from the head body 2 for circulation of ink are illustrated. However, in some embodiment, for example, other configurations as described below may be employed to circulate ink.

Figure 9:
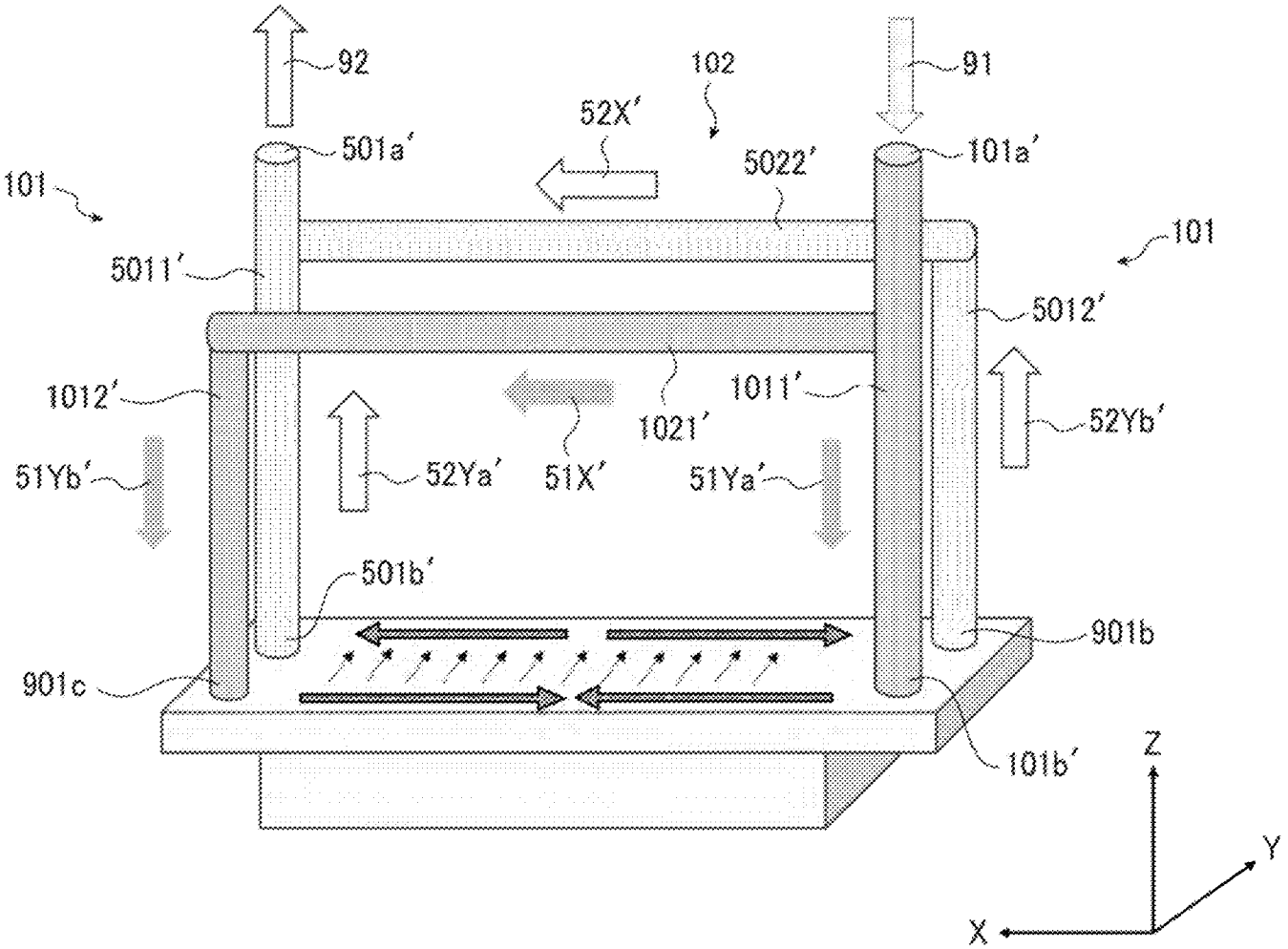
FIG. 9 is an illustration of another configuration example in which ink is circulated.

FIG. 9 is an illustration of another configuration example in which ink is circulated. In the configuration of FIG. 9, unlike the configuration of FIG. 5, ink can be circulated in each supply port relay portion 101. In FIG. 9, one supply port relay portion 101 includes a channel 1011' and a channel 5012'. The channel 1011' is a vertical path to supply ink from an ink supply port 101*a*' to an ink supply destination 101*b*'. The channel 5012' is a vertical path to collect the supplied ink from an ink collection destination 901*b* to a module relay portion 102. The other supply port relay portion 101 of the supply port relay portions 101 includes a channel 1012' and a channel 5011'. The channel 1012' is a vertical path to supply ink from the ink supply port 101*a*' to an ink supply destination 901*c* of the other supply port relay portion 101 via the module relay portion 102. The channel 5011' is a vertical path to collect the supplied ink from an ink collection destination 501*b*' to an ink collection port 501*a*'.

Further, in FIG. 9, the module relay portion 102 includes a channel 1021' and a channel 5022' to connect the supply port relay portions 101 to each other. The channel 1021' is a channel to supply the ink from the ink supply port 101*a*', from the channel 1011' of the one supply port relay portion 101 to the channel 1012' of the other supply port relay portion 101. The channel 5022' is a channel to collect the ink collected from the ink collection destination 901*b* of the one supply port relay portion 101, from the channel 5012' to the channel 5011'.

In other words, the ink supplied from the ink supply port 101*a*' in the direction 91 is separated in a direction 51X' and a direction 51Ya' in the one supply port relay portion 101 of the relay module component 100 and then supplied to the head body 2. Further, the ink is supplied to the head body 2 in a direction 51Yb' in the other supply port relay portion 101 on the opposite side via the module relay portion 102. In addition, in the one supply port relay portion 101 of the relay module component 100, the ink collected from the ink collection destination 901*b* in a direction 52Yb' is collected in a direction 52X' through the module relay portion 102 and then collected in a direction 92 in the channel 5011' of the other supply port relay portion 101. The ink collected in a direction 52Ya' from a collection destination 501*b*' is collected in the direction 92 in the channel 5011' of the other supply port relay portion 101.

Figures 2, 10A:
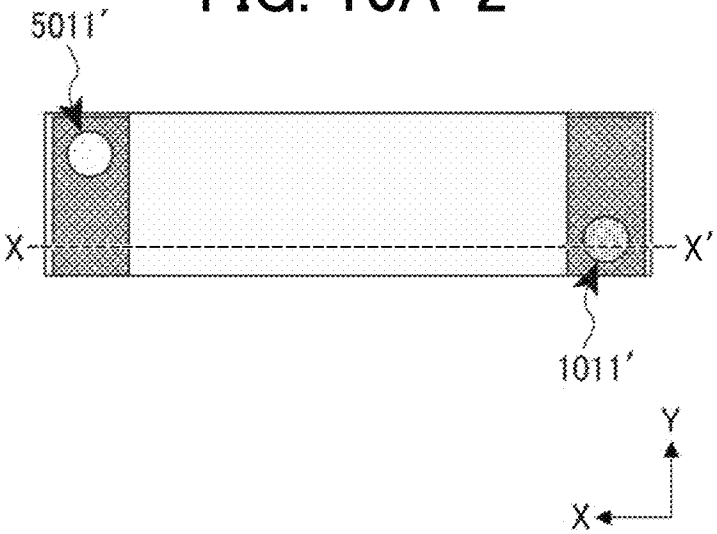
Figures 1, 10A:
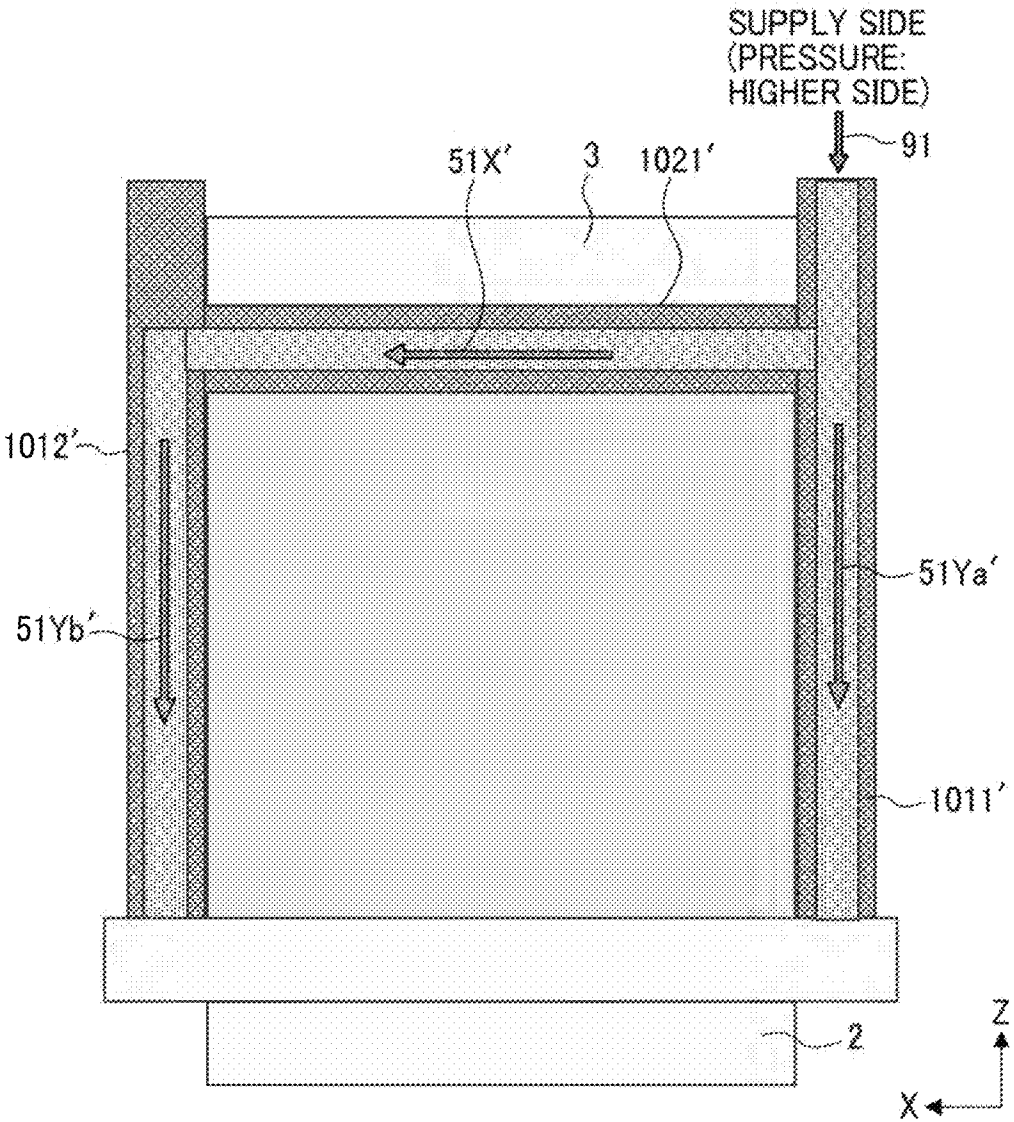

FIG. 10A-1 is a cross-sectional view of the front side of the configuration example illustrated in FIG. 9 taken along line X-X'. FIG. 10A-2 is a top view of the configuration example illustrated in FIG. 9. As illustrated in FIG. 10A-1, the ink supplied from the ink supply port 101*a* in the direction 91 is separated into the direction 51Ya' and the direction 51X' and then supplied to the head body 2. The ink separated in the direction 51X' is supplied in the direction 51Yb' of the channel 1012' and is supplied to the head body 2. In addition, as illustrated in FIG. 10A-2, the channel 1011' and the channel 5011' are disposed at positions in a diagonal direction of the head body 2 so that the ink supply port 101*a*' and the ink collection port 501*a*' of the supply port relay portion 101 are on the opposite sides of the head body 2.

Figures 2, 10B:
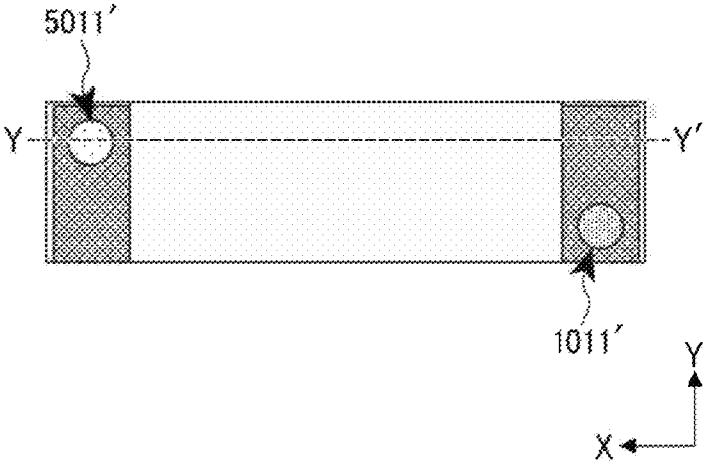
Figures 1, 10B:
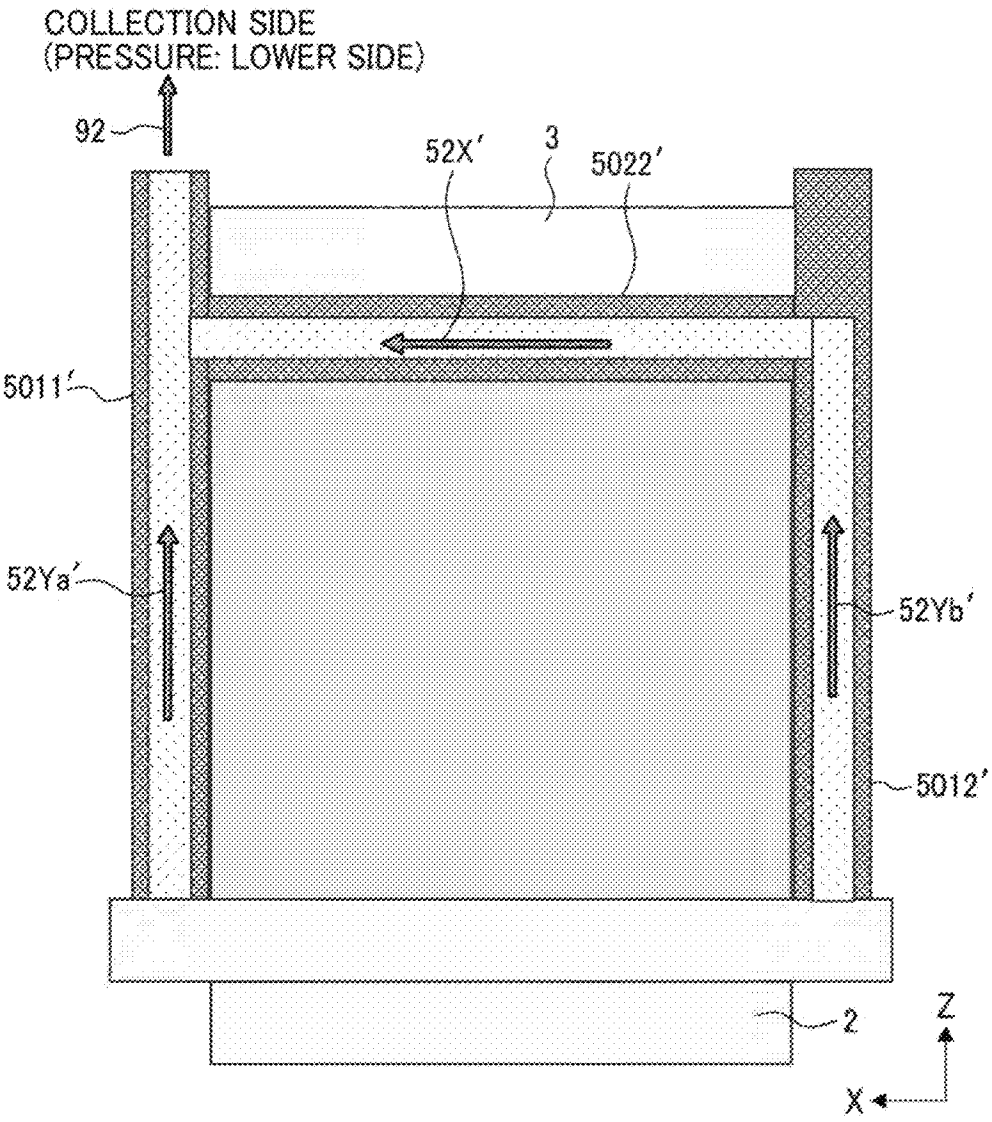

FIG. 10B-1 is a cross-sectional view of the opposite side of the front side of the configuration example illustrated in FIG. 9 taken along line Y-Y'. FIG. 10B-2 is a top view of the configuration example illustrated in FIG. 9. As illustrated in FIG. 10B-1, ink collected in the direction 92 to the ink collection port 501*a*' is collected from the direction 52Ya' and a direction 52X'. The ink collected from the direction 52X' is collected from a direction 52Yb' of the channel 5012'. Since FIG. 10B-2 is the same as FIG. 10A-2, the description of FIG. 10B-2 is omitted here.

Figures 1, 2, 10C:
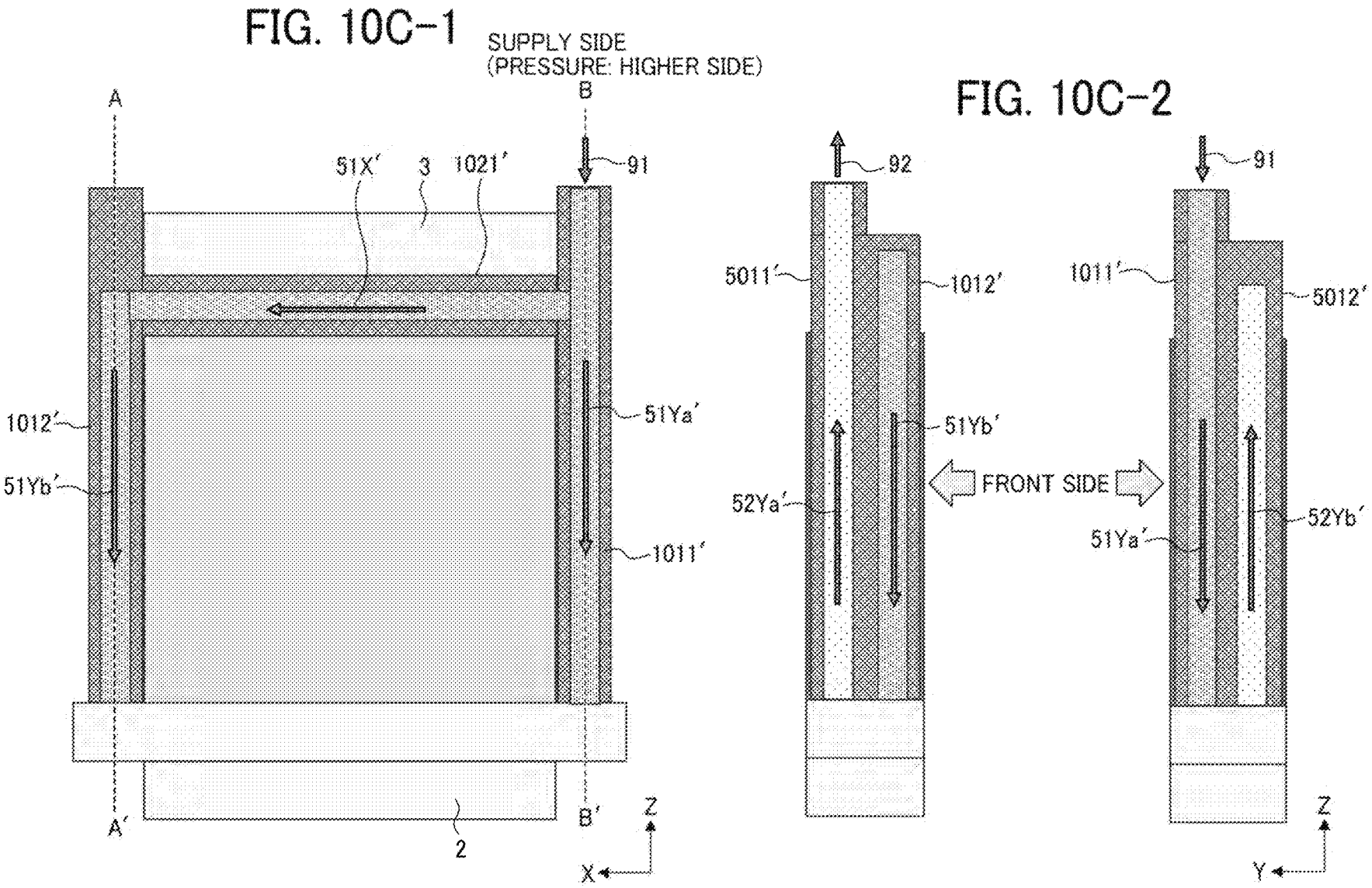

FIG. 10C-1 is a cross-sectional view of the front side of the configuration example illustrated in FIG. 9 taken along line X-X'. FIG. 10C-2 includes cross-sectional side views of the configuration example taken along line A-A' and line B-B' of FIG. 10C-1. Since FIG. 10C-1 is the same as FIG. 10A-1, the description thereof is omitted and FIG. 10C-2 is described below. As illustrated in FIG. 10C-2, each of the supply port relay portions 101 on both sides of the head body 2 includes a vertical channel to supply ink and a vertical channel to collect ink. For example, the supply port relay portion 101 illustrated in the cross-sectional view of FIG. 10C-2 taken along the line A-A' includes the channel 1012' to supply ink in the direction 51Yb' and the channel 5011' to collect ink in the direction 52Ya'. For example, the supply port relay portion 101 illustrated in the cross-sectional view of FIG. 10C-2 taken along the line B-B' includes the channel 1011' to supply ink in the direction 51Ya' and the channel 5012' to collect ink in the direction 52Yb'.

Figures 1, 10D:
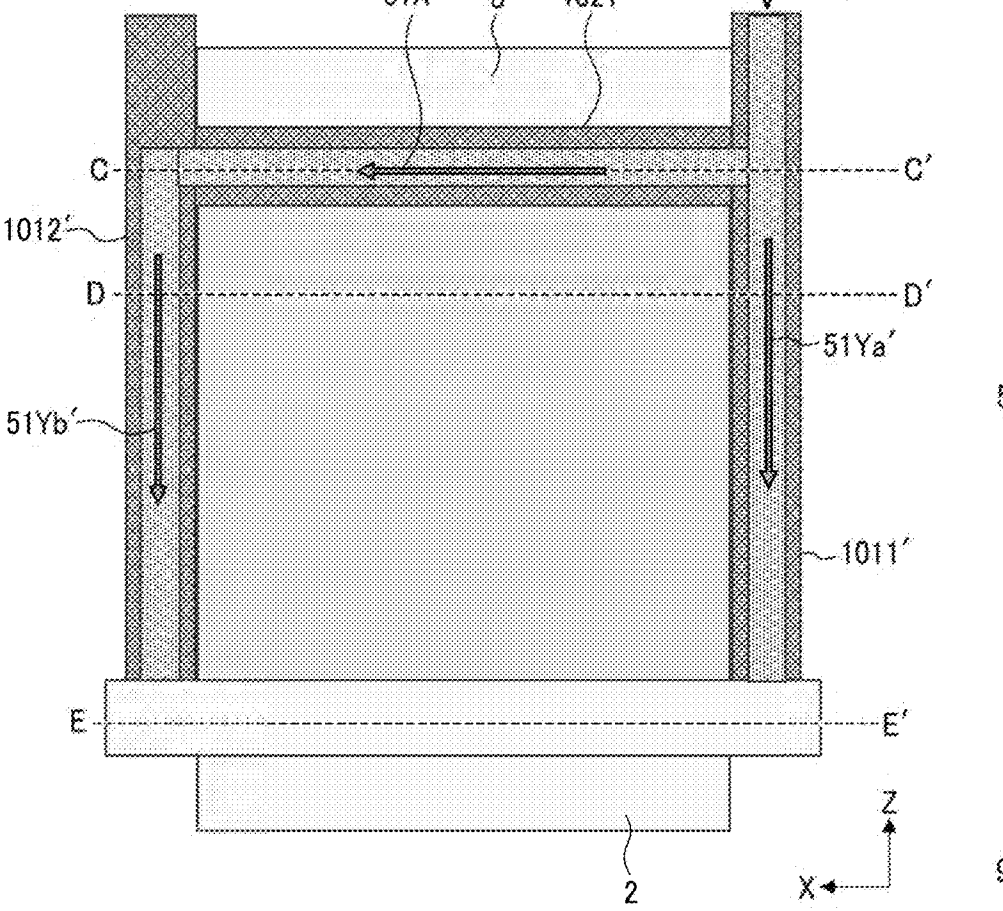
Figures 2, 10D:
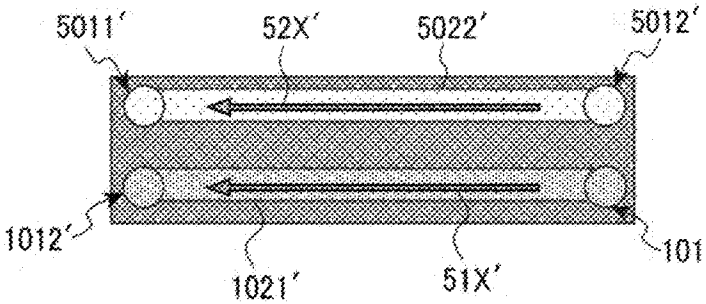
Figures 3, 10D:
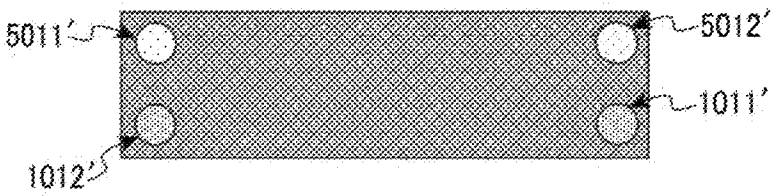
Figures 4, 10D:
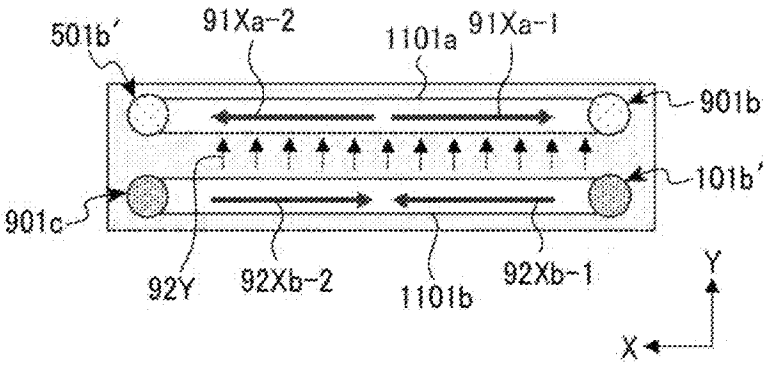

FIG. 10D-1 is a cross-sectional view of the front side of the configuration example illustrated in FIG. 9 taken along line X-X'. FIG. 10D-2 is a top view of the configuration example illustrated in FIG. 9 taken along line C-C' of FIG. 10D-1. FIG. 10D-3 is a top view of the configuration example taken along line D-D' of FIG. 10D-1. FIG. 10D-4 is a top view of the configuration example taken along line E-E' of FIG. 10D-1. Since FIG. 10D-1 is the same as FIG. 10A-1, the description thereof is omitted and FIG. 10D-2, 10D-3, and 10D-4 are described below. As illustrated in FIGS. 10D-2, 10D-3, and 10D-4, the module relay portion 102 that relays the supply port relay portions 101 on both sides of the head body 2 includes a horizontal channel to supply ink and a horizontal channel to collect ink. For example, the module relay portion 102 illustrated in the top view of FIG. 10D-2 taken along the line C-C' has a channel 1021' to supply ink in a direction 51X' parallel to the longitudinal direction of the head body 2. In addition, for example, the module relay portion 102 illustrated in the top view of FIG. 10D-3 taken along the line E-E' has a channel 5022' to collect ink in a direction 52X' parallel to the longitudinal direction of the head body 2. Further, for example, the module relay portion 102 illustrated in the top view of FIG. 10D-4 taken along the line E-E' includes a channel 1101*a* to circulate ink in a direction 91Xa-1 and a direction 91Xa-2 and a channel 1101*b* to circulate ink in a direction 92Xb-1 and a direction 92Xb-2. The direction 91Xa-1 and the direction 91Xa-2 are directions from the central portion toward the end portions along the longitudinal direction. The direction 92Xb-1 and the direction 92Xb-2 are directions from the end portions toward the central portion along the longitudinal direction, which are opposite to the direction 91Xa-1 and the direction 91Xa-2, respectively. Further, the ink supplied in the direction 91Xa-1 and the direction 91Xa-2 is also supplied in a direction 92Y from the channel 1101*b* toward the channel 1101*a* through the nozzles arranged in the head body 2.

Such a configuration allows ink to circulate in each common liquid chamber. At this time, providing a pressure difference between both sides of the head body 2 (head portions at both ends in the longitudinal direction of the head body 2) causes ink in the respective liquid chambers to be individually circulated in each of the liquid chambers. Thus, the ink can be circulated without designing a special ink tank. The carriage size can be designed to be compact without using the upper space of the head body 2 while the ink tank is provided with the head 2.

Figure 11:
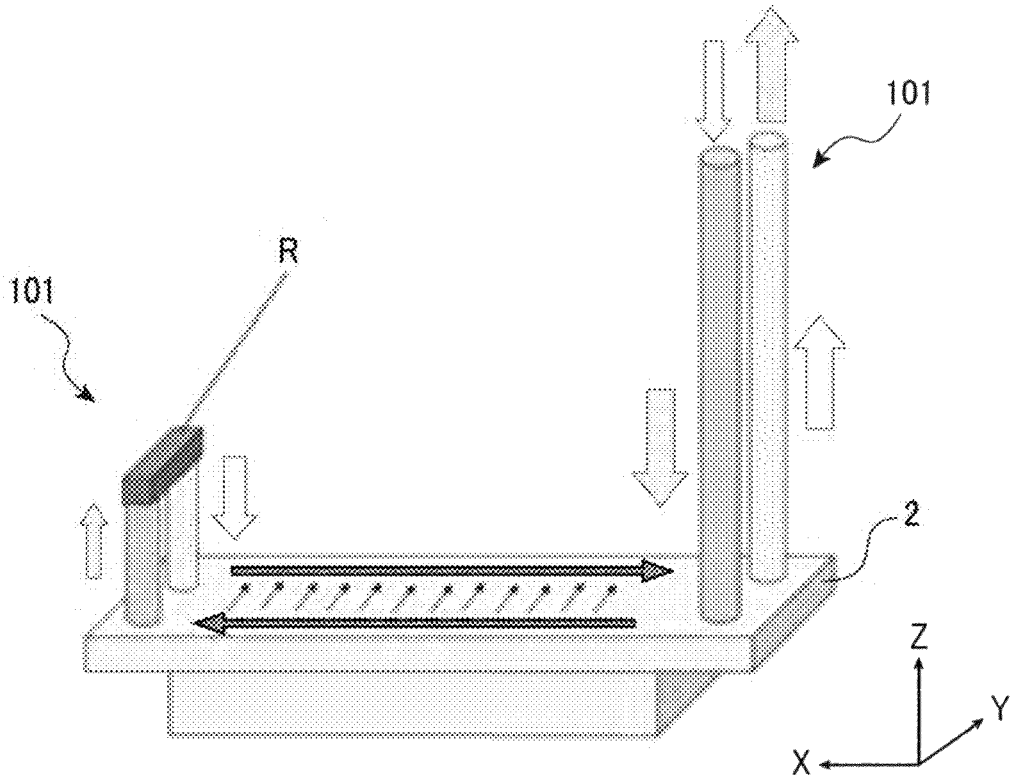
FIG. 11 is an illustration of another configuration example in which ink is circulated.

FIGS. 9 and 10A-1 to 10D-4 illustrate examples in which ink is circulated through the two supply port relay portions 101 provided on both sides of the head body 2. In some embodiments, for example, as illustrated in FIG. 11, an ink temperature adjustment device R may be built in one supply port relay portion 101 to control the temperature of ink in circulation. The ink temperature adjustment device R may include, for example, a vacuum pump for deaeration or a stirrer for stirring.

Figure 12:
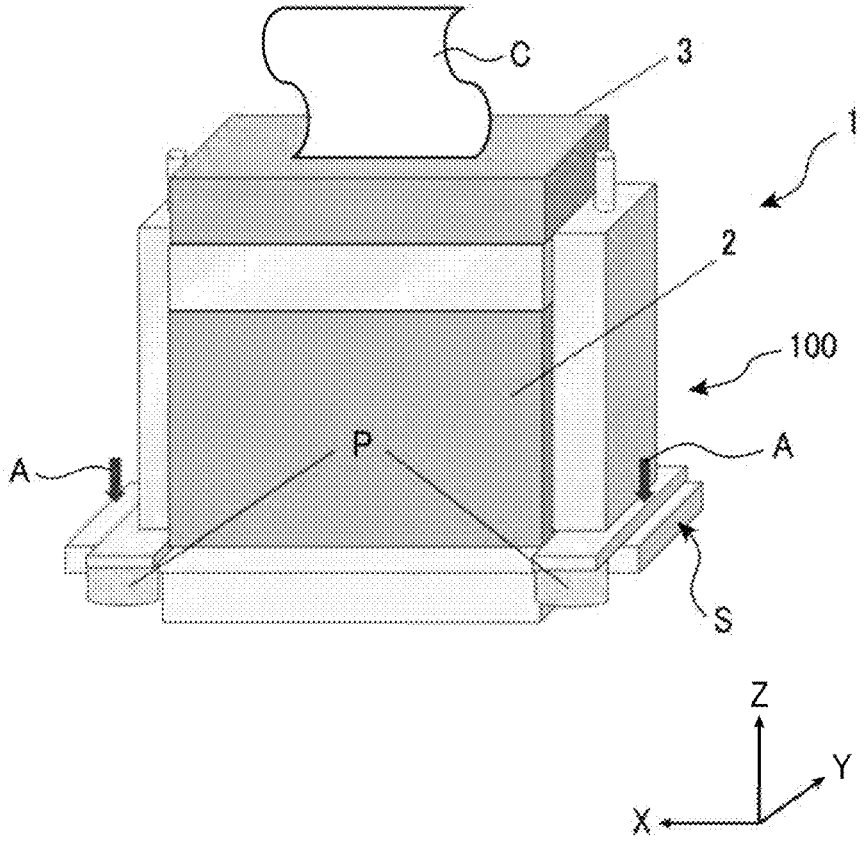
FIG. 12 is an illustration of a configuration example of a print head with position adjustment pins that contact side surfaces of a head body.

As illustrated in FIG. 12, position adjustment pins P that contact the side surfaces of the head body 2 are attached to the relay module component 100 in the present embodiment. The position adjustment pin P has an elliptical shape, can be rotated and fixed, and can adjust the position between a reference surface S of a side surface in the longitudinal direction of the head body 2 and a mounter of the printer. In addition, since the relay module component 100 is fixed and positioned, it is not necessary to readjust the position when only the head body 2 is replaced. For example, the distance to the contact surface on the printer side is adjusted with a projecting portion such as the position adjustment pin P, and is fixed at an adjusted position after the adjustment. Thus, marking the relay module component 100 as the initial mounting position of the head body 2 can obviate the necessity of readjustment at the time of replacement of the head body 2. Further, since the position adjusting pins P are provided, the components corresponding to the reference of the print head can be accurately mounted. Further, when the accuracy of the mounter of the printer is low, the mounting accuracy at the time of head replacement can be enhanced.

In FIG. 12, the relay module component 100 is provided with the position adjustment pins P for alignment with the reference pin of the head body 2. However, in some embodiments, for example, a groove of a pin receiver or a projection (for example, a projecting wall surface or pin) for contacting a side surface serving as a reference surface of the head body 2.

As described above, the liquid discharge head according to the above-described embodiment is a liquid discharge head that discharges ink supplied from a connector an ink chamber. The liquid discharge head includes the relay module component 100 that is inserted between the connector component 3 electrically connected to the drive board of the liquid discharge head and the head unit (head body 2), which is a destination to which ink supplied from the ink chamber is supplied, and is attachable to and detachable from the connector component 3 and the head unit. In other words, the liquid discharge head includes a relay module component including a channel to supply ink supplied from the ink chamber to the head unit. In other words, the relay module component connected between the inkjet print head and the cable component is a relay component that can be inserted between the head and the separable electrical wiring connector without increasing the width and depth of the head, and the relay component has functions of integrating and branching the ink paths and controlling the ink temperature. Thus, such a configuration can prevent the viscosity of ink from decreasing due to excessive heating of ink by the drive circuit, thus preventing discharge failure.

In liquid discharge apparatuses, an ink path may be provided in a cover covering a driving element to cool a drive circuit facing the cover. When the drive circuit excessively generates heat, the temperature of ink may be excessively increased, thus decreasing the viscosity of the ink and resulting in unstable discharge.

However, the relay module component according to the present embodiment can be attached as a relay component between the print head and a separable cable component. The ink paths are disposed outside the head apart from the drive circuit. Such a configuration can prevent an increase in width and depth as an external size while having functions of integrating and branching the ink paths according to the number of ink used in relaying the ink from the ink tank to the head and a function of controlling the ink temperature.

In addition, the relay module component according to the present embodiment is a relay component that can be directly attached to the print head, in the head including the print head and the separate cable component, and includes a component for integrating and branching the ink paths. Such a configuration allows the ink paths to be integrated and branched immediately above the ink ports of the print head, and prevent the width and depth of the head from increasing with the attachment of the ink path component. Since the integration and branching of a tube processed by the customer as in a conventional case are not required, a gap is formed in the layout around the mounting part of the print head, thus facilitating handling.

Further, since the relay module component is connected to the separable cable component, the ink temperature can be controlled upstream from the print head by using power supply such as heater driving of the print head. In a typical head, the temperature of ink in the ink tank is controlled. When the path to the print head is long, the ink may be cooled. With the above-described configuration according to the present embodiment, the temperature of ink can be controlled immediately above the head, thus allowing stable control of ink temperature.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A liquid discharge head, comprising:

a connector electrically connectable to a drive board;

a head body to which ink from an ink chamber is supplied; and a relayer between the connector and the head body, the relayer being detachable from the connector and the head body, the relayer including a channel to supply the ink supplied from the ink chamber to the head body, wherein the relayer includes:

a plurality of first relay portions at both end portions of the head body, each of the plurality of first relay portions having a vertical channel to supply the ink supplied from the ink chamber to the head body; and a second relay portion having a horizontal channel to relay supply of the ink between the plurality of first relay portions.

2. The liquid discharge head according to claim 1, wherein the relayer includes an ink supply port to receive the ink supplied from the ink chamber, the head body includes a plurality of supply ports to receive the ink supplied from the ink supply port, the plurality of supply ports is greater in number than the ink supply port, and the channel of the relayer is branched between the ink supply port and the plurality of supply ports.

3. The liquid discharge head according to claim 1, wherein the relayer includes a plurality of ink supply ports to receive the ink supplied from the ink chamber, the head body includes a supply port to receive the ink supplied from the plurality of ink supply ports, the supply port is smaller in number than the plurality of ink supply ports, and the channel of the relayer is branched between the plurality of ink supply ports and the supply port.

4. The liquid discharge head according to claim 1, wherein the connector is configured to divide a current to control a temperature inside the relayer.

5. The liquid discharge head according to claim 1, wherein the relayer includes a stirrer configured to stir the ink in the relayer.

6. The liquid discharge head according to claim 1, wherein the relayer includes a removable filter in the channel.

7. The liquid discharge head according to claim 1, wherein the head body includes a reference pin, and the relayer includes a pin receiving groove to align with the reference pin.

8. The liquid discharge head according to claim 1, wherein the relayer includes a projection to contact a side surface of the head body.

9. The liquid discharge head according to claim 8, wherein the projection is configured to adjust a distance to a contact surface of an image forming apparatus and fix the liquid discharge head at an adjusted position after adjustment of the distance.

10. The liquid discharge head according to claim 1, wherein a pressure of the ink supplied to the channel of the relayer is adjustable.

11. The liquid discharge head according to claim 1, wherein one of the plurality of first relay portions includes:

a first supply channel extending in a vertical direction to supply the ink supplied from the ink chamber to the head body; and a first collection channel extending in the vertical direction to collect the supplied ink to the second relay portion, and another one of the plurality of first relay portions includes:

a second supply channel extending in the vertical direction to supply the ink from the ink chamber to the head body via the second relay portion; and a second collection channel extending in the vertical direction to collect the supplied ink from the head body to an ink collection port, wherein the second relay portion includes:

a first relay channel to relay the ink supplied from the first supply channel to the second supply channel; and a second relay channel to relay the ink collected from the first collection channel to the second collection channel.

12. A liquid discharge apparatus, comprising the liquid discharge head according to claim 1.

* * * * *